US006794611B2

(12) United States Patent
Kataoka et al.

(10) Patent No.: US 6,794,611 B2
(45) Date of Patent: Sep. 21, 2004

(54) IMAGE HEATING APPARATUS HAVING ROTARY METAL MEMBER IN CONTACT WITH HEATER, SUCH ROTARY MEMBER AND PRODUCING METHOD THEREFOR

(75) Inventors: Hiroshi Kataoka, Shizuoka (JP); Akihito Kanamori, Shizuoka (JP); Satoru Izawa, Shizuoka (JP); Eiji Uekawa, Shizuoka (JP); Shinji Hashiguchi, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/212,797

(22) Filed: Aug. 7, 2002

(65) Prior Publication Data

US 2003/0038125 A1 Feb. 27, 2003

(30) Foreign Application Priority Data

Aug. 10, 2001 (JP) ..... 2001-244287
Jul. 30, 2002 (JP) ..... 2002-221109

(51) Int. Cl.[7] ..... G03G 15/20
(52) U.S. Cl. ..... 219/216; 399/329
(58) Field of Search ..... 219/216; 399/328–333

(56) References Cited

U.S. PATENT DOCUMENTS 4,970,219 A 11/1990 Effland et al. ..... 514/339
5,148,226 A * 9/1992 Setoriyama et al. ..... 399/329
5,149,941 A 9/1992 Hirabayashi et al. ..... 219/216
5,210,579 A 5/1993 Setoriyama et al. ..... 355/285
5,401,936 A 3/1995 Kusaka et al. ..... 219/216
5,450,181 A 9/1995 Tsukida et al. ..... 355/282
5,525,775 A 6/1996 Setoriyama et al. ..... 219/216
5,722,026 A 2/1998 Goto et al. ..... 399/333
5,904,871 A 5/1999 Sakai et al. ..... 219/216
5,920,757 A 7/1999 Izawa et al. ..... 399/329
6,002,106 A 12/1999 Kataoka et al. ..... 219/216
6,438,348 B2 8/2002 Kobaru et al. ..... 399/333

FOREIGN PATENT DOCUMENTS

JP 63-313182 12/1988
JP 02-157878 6/1990
JP 4-44075 2/1992
JP 04-166967 * 6/1992
JP 04-204980 7/1992
JP 04-343381 * 11/1992
JP 11-102133 4/1999

* cited by examiner

*Primary Examiner*—Joseph Pelham
(74) *Attorney, Agent, or Firm*—Fitzpatrick, Cella, Harper & Scinto

(57) ABSTRACT

An image heating apparatus for an image forming apparatus comprises a heater and a rotary member having plasticity and rotated in contact with the heater. The rotary member in the image heating apparatus has an external shape becoming larger toward the end portions in the longitudinal direction, thereby preventing generation of wrinkles or unevenness in the conveyed recording medium.

22 Claims, 14 Drawing Sheets

S-S CHARACTERISTICS

S-S CHARACTERISTICS

S-S CHARACTERISTICS

IMAGE HEATING APPARATUS HAVING ROTARY METAL MEMBER IN CONTACT WITH HEATER, SUCH ROTARY MEMBER AND PRODUCING METHOD THEREFOR

BACKGROUND OF THE INVENTION

1. Field of the Invention

The present invention relates to an image heating apparatus adapted for use as a fixing device of an image forming apparatus such as a copying apparatus or a printer employing electrophotographic or electrostatic recording method, a rotary member employed in such image heating apparatus and a method for producing the rotary member.

2. Related Background Art

As the heat fixing apparatus, there has conventionally been employed apparatus of heat roller type or film heating type. In particular, the Japanese Patent Application Laid-open Nos. 63-313182, 2-157878, 4-44075 and 4-204980 propose a method, more specifically a heat fixing method of film heating type in which a toner image on a recording material is fixed across a film between a heater portion and a pressure roller, of not supplying the heat fixing apparatus with an electric power at the stand-by state thereby minimizing the electric power consumption.

The configuration of the heat fixing apparatus of film heating type is known in a method of conveying a film in cooperation with a pressure roller under a tension applied by a conveying roller exclusive for film conveying and an idler roller, and a method of driving a cylindrical film by the conveying force from a pressure roller, wherein the former provides an advantage of maintaining secure conveying ability for the film while the latter provides an advantage of realizing a fixing apparatus of low cost resulting from a simpler configuration.

As a specific example, FIG. 2 shows, in a schematic lateral cross-sectional view, a fixing apparatus of the film heating type of the aforementioned latter configuration in the pressure roller driving method, and FIG. 3 is a magnified cross-sectional view of the principal part.

In such apparatus, there are provided a heating member (hereinafter represented as heater) 11 fixedly supported by a heater holder (support member) 12, and an elastic pressure roller 20 maintained in pressure contact with the heater 11 thereby forming a nip portion (fixing nip) N of a predetermined nip width across a heat-resistant thin film (hereinafter represented as fixing film) 13.

The heater 11 is heated and maintained at a predetermined pressure by electric current supply.

The fixing film 13 is a rotary member (rotation body) for heat fixing, which is composed of a cylindrical thin member conveyed in a direction, indicated by an arrow, in sliding contact with the surface of the heater 11 at the fixing nip N by the rotary driving force of the pressure roller 20.

In a state where the heater 11 is heated and maintained at the predetermined temperature and the fixing film 13 is moved in the direction indicated by the arrow, when a recording material P bearing an unfixed toner image t is introduced, as a material to be heated, into the fixing nip N between the fixing film 13 and the pressure roller 20, the recording material P is maintained in close contact with the surface of the fixing film 13 and is conveyed in a sandwiched state in the fixing nip N together with the fixing film 13.

In the fixing nip N, the unfixed toner image on the recording material P is heated by the heater 11 across the fixing film 13 and is thermally fixed as a permanent image on the recording material P.

Having passed the fixing nip N, the recording material P is peeled from the surface of the fixing film 13 and is further conveyed.

The heater 11, constituting the heating member, generally includes a ceramic heater, which will be further clarified with reference to FIGS. 3 and 4.

It is formed, on a surface (opposed to the fixing film 13) of an electrically insulating ceramic substrate 11*a* of a high thermal conductivity and a low heat capacity, by forming a heat-generating resistor layer 11*b* such as of silver palladium (Ag/Pd) or $Ta_2N$ for example by screen printing along the longitudinal direction of the substrate (perpendicular to the plane of FIG. 3) and covering the surface bearing the heat-generating resistor layer with a thin glass protective layer 11*c*. In such ceramic heater 11, by passing an electric current through the heat-generating resistor layer 11*b*, such heater generates heat to rapidly elevate the temperature of the entire heater including the ceramic substrate 11*a* and the glass protective layer 11*c*. The temperature increase of the heater 11 is detected by temperature detecting means 14 provided on the rear surface of the heater and is fed back to an current control unit (not shown), which controls the current supply to the heat-generating resistor layer 11*b* in such a manner that the heater temperature detected by the temperature detecting means 14 is maintained at a predetermined substantially constant temperature (fixing temperature). In this manner the heater 11 is heated and maintained at the predetermined fixing temperature.

The fixing film 13, constituting the rotary member for heat fixing, is made with the thickness of 20 to 70 $\mu$m, in order to efficiently transmit the heat from the heater 11 to the recording material P to be heated, in the fixing nip N. The fixing film 13 has a three-layered structure including of a base film layer, a primer layer and a releasing layer. The base film layer is positioned at the side of the heater 11, while the releasing layer is positioned at the side of the pressure roller 20.

The base film layer is composed of polyimide, polyamidimide, PEEK etc. having a higher insulation than the glass protective layer 11*c* of the heater 11, and has heat resistance and a high elasticity. Also the base film layer maintains the mechanical strength such as tear strength of the entire fixing film. The primer layer is formed with the thickness of 2 to 6 $\mu$m. The releasing layer is provided for preventing toner offsetting to the fixing film, and is formed by coating fluorinated resin such as PFA, PTFE or FEP with a thickness of about 10 $\mu$m.

The heater holder 12 is for example formed by a member of heat resistant plastics and serves as a conveying guide for the fixing film, as well as supporting the heater.

In such heating apparatus of the film heating type utilizing a thin fixing film, because of the high rigidity of the ceramic heater 11 constituting the heating member, the pressure roller 20 having an elastic layer 22 is pressed to the flat lower surface of the heater 11 to form the fixing nip portion N of a predetermined width, and quick-starting heat fixation is realized by heating the fixing nip portion N only.

In the above-described configuration, the positional relationship between the heat-generating resitor layer 11*b* of the heater 11 and the pressure roller 20 will be explained with reference to FIG. 4, in which the longitudinal width W of the heat-generating resistor layer 11*b* of the heater 11 is formed somewhat narrower than the width D of the elastic layer 22 of the pressure roller 20 maintained in contact across the fixing film 13. Such relationship is adopted in order to prevent breakage of the heater 11 by a thermal stress resulting from local temperature rise therein, in case the heat-generating resistor layer 11*b* is wider than the pressure roller 20.

Also the heat-generating resistor layer 11*b* is formed with such a width sufficiently wider than the conveying area of the recording material P bearing the toner image t. It is thus made possible to avoid the influence of temperature decrease in the end portions (caused by heat leakage to the electrical contacts, connectors etc. at the heater ends), thereby realizing satisfactory fixing performance over the entire surface of the recording material. It is also possible to form the heat-generating resistor layer narrower in the end portions of the sheet passing area to increase the heat generation in such end portions, thereby enhancing the fixing performance therein.

Thus, the heat generated by the electric current supply in the heat-generating resistor layer 11*b* of the heater 11 is efficiently supplied to the recording material P conveyed between the fixing film 13 and the pressure roller 20, and serves to fuse and fix the toner image t on the recording material P.

A symbol S indicates a standard or reference position for the conveying operation of the recording material. The present example is a center-reference apparatus in which the reference position is provided at the center, in the longitudinal direction, of the conveying area of the recording material in the main body of the image forming apparatus.

Also as shown in FIG. 4, on the rear surface of the heater, there are maintained in contact a temperature detecting element 14 such as a thermistor and a thermo protector 15 such as a temperature fuse or a thermo switch, for shutting down the current supply to the heat-generating resistor layer 11*b* of the heater 11 in case the operation becomes uncontrollable. These elements are positioned within the conveying area of the recording material of a smallest width, that can be conveyed in the image forming apparatus.

The temperature detecting element 14 is provided in the conveying area of the recording material of the smallest width, in order to achieve heat fixation of the toner image on the recording material without defective fixation or high temperature offsetting, even in case the recording material of the smallest width conveyable in the main body of the image forming apparatus is conveyed.

Also the thermo protector 15 is provided in the conveying area of the recording material of the smallest width, in order to prevent erroneous shut-down of the current supply in the normal conveying operation, by overheating in the non-conveying area having a smaller heat resistance than in the conveying area in case the recording material of the smallest width is conveyed.

On the other hand, in the case that the thermo protector 15 is in contact with the rear surface of the heater, there may result a situation where the heat generated in the heat-generating resistor layer 11*b* is taken away by the thermo protector 15 and cannot be sufficiently given to the recording material, thereby inducing insufficient fixation at the contact position of the thermo protector. In order to avoid such phenomenon, the heat-generating resistor layer 11*b* of the heater 11 is made partly somewhat narrower as shown in FIG. 4 to increase the resistance of the contact position a in comparison with other portions, thereby ensuring sufficient heat generation. In this manner the amount of heat supply to the recording material is made uniform over the entire longitudinal direction, thereby realizing satisfactory heat fixation without unevenness in the fixing performance.

As the temperature detecting element 14 is also maintained in contact with the rear surface of the heater, it is conceived that the heat generated by the heat-generating resistor layer 11*b* is similarly taken away by the temperature detecting element 14, but the amount of heat taken away from the heater can be made small by selecting a temperature detecting element of a low heat capacity such as a chip thermistor. Therefore, uniform fixation can be realized without deteriorating the fixing uniformity for the recording material in the longitudinal direction, without adopting a countermeasure similar to the above explanation explained for the thermo protector 15.

The heat fixing apparatus of the film heating type explained in the foregoing has various advantages such as electric power saving and elimination of waiting time for the user because the preliminary heating during stand-by state can be dispersed with owing to the high heating efficiency and the possibility of quick start. In particular, the configuration of driving the cylindrical film 13 with the conveying force of the pressure roller 20, being capable of achieving a low cost, has started to be introduced into the compact low-speed apparatus and is expected to be hereafter adopted in the large high-speed apparatus.

For achieving such higher speed fixation, sufficient thermal energy for fixation has to be supplied even to the recording material P having a shorter passing time through the fixing nip portion N. For achieving such objective, there can be conceived a method of further elevating the fixing temperature, a method of increasing the pressure between the pressure roller 20 and the fixing film 13 thereby increasing the width of the fixing nip serving as the heating area, or a method of changing the material of the heater substrate 11*a* or the fixing film 13 to another with a higher thermal conductivity thereby increasing the supply amount of heat.

However, such changes increase the burden on the fixing film 13, constituting the heat fixing rotary member, thereby leading to a drawback of accelerating the deterioration thereof and reducing the service life thereof.

For example, if the amount of filler of high thermal conductivity such as BN (boron nitride) or ALN (aluminum nitride) is increased in order to improve the thermal conductivity of the base film layer of the fixing film, the flexibility or strength of the resinous material itself such as polyimide (PI) resin is deteriorated whereby the abrasion or deterioration of the fixing film 13 is accelerated.

For this reason, it is newly conceived to adopt a metal, which is superior in thermal conductivity to resinous materials, as the base layer of the fixing film 13 constituting the heat fixing rotary member.

When used as the heat fixing rotary member, a metal sleeve, because of the thermal conductivity of the constituent material, is capable of transmitting sufficient thermal energy for fixation to the recording material even without relying on a higher fixing temperature or increasing the pressure for widening the fixing nip, thereby realizing a fixing apparatus of film heating type adaptable to a higher speed.

Such metal base layer, however, is revealed to result in the following problem, if the metal base layer has a straight shape in which the external diameter at the center is equal to that at both ends.

In case the metal base layer has a straight shape, because the external diameter thereof at the center is equal to that at both ends, the conveying speed of the recording material P in passing the fixing nip portion N becomes the same as one at the central position of the recording material and at the end positions thereof in the conveying direction, thereby generating wrinkles (crease) or uneven gloss in the recording material.

SUMMARY OF THE INVENTION

In consideration of the foregoing, an object of the present invention is to provide an image heating apparatus of a low electric power consumption, adaptable to high speed heating, and a rotary member adapted for use in such apparatus.

Another object of the present invention is to provide an image heating apparatus capable of suppressing wrinkle generation in the recording material, and a rotary member adapted for use in such apparatus.

A further object of the present invention is to provide a method for producing a flexible metal rotary member of a high production yield.

A further object of the present invention is to provide an image heating apparatus comprising a heater, a rotary member having flexibility and adapted to rotate in contact with the heater, the rotary member including a metal base layer, and a back-up member for forming a nip portion in cooperation with the heater across the rotary member, wherein the rotary member includes an area in which the external diameter increases toward the ends in the longitudinal direction of the rotary member.

A further object of the present invention is to provide a rotary member adapted for use in an image heating apparatus, the rotary member comprising, a metal base layer having flexibility, wherein the rotary member includes an area in which the external diameter increases toward the ends in the longitudinal direction.

A further object of the present invention is to provide a method for producing a rotary member, comprising, a step of ironing a metal pipe having flexibility, a step of subjecting the metal pipe subjected to the ironing step to plastic working thereby forming an area in which the external diameter increases toward the ends in the longitudinal direction, and a step of sintering a resin layer on the surface of the metal pipe subjected to the plastic working.

Still another object of the present invention is to provide a method for producing a rotary member, comprising a step of ironing a metal pipe having flexibility thereby forming an area in which the external diameter increases toward the ends in the longitudinal direction, and a step of sintering a resin layer on the surface of the metal pipe subjected to the ironing.

As still further object of the present invention is to provide a method for producing a rotary member, comprising, a step of ironing a metal pipe having flexibility, a step of subjecting the metal pipe subjected to the ironing step to annealing, a step of sintering a resin layer on the surface of the metal pipe subjected to the annealing, and a step of subjecting the metal pipe subjected to the formation of resin layer to plastic working thereby forming an area in which the external diameter increases toward the ends in the longitudinal direction.

These and other objects of the present invention, and the features thereof, will become fully apparent from the following detailed description which is to be taken in conjunction with the accompanying drawings.

DETAILED DESCRIPTION OF THE PREFERRED EMBODIMENTS

In the following, there will be given a detailed explanation, with reference to accompanying drawings, on an image heating rotary member of the present invention and an image forming apparatus provided with a heat fixing apparatus utilizing such rotary member. In the following embodiment, the description will omit the entire configuration and the function of the image forming apparatus and will be concentrated on the portions featuring the present invention. Also components equivalent in function to those explained in the foregoing will be represented by corresponding numbers and will not be explained further.

First Embodiment (A) Embodiment of Image Forming Apparatus

Figure 5:
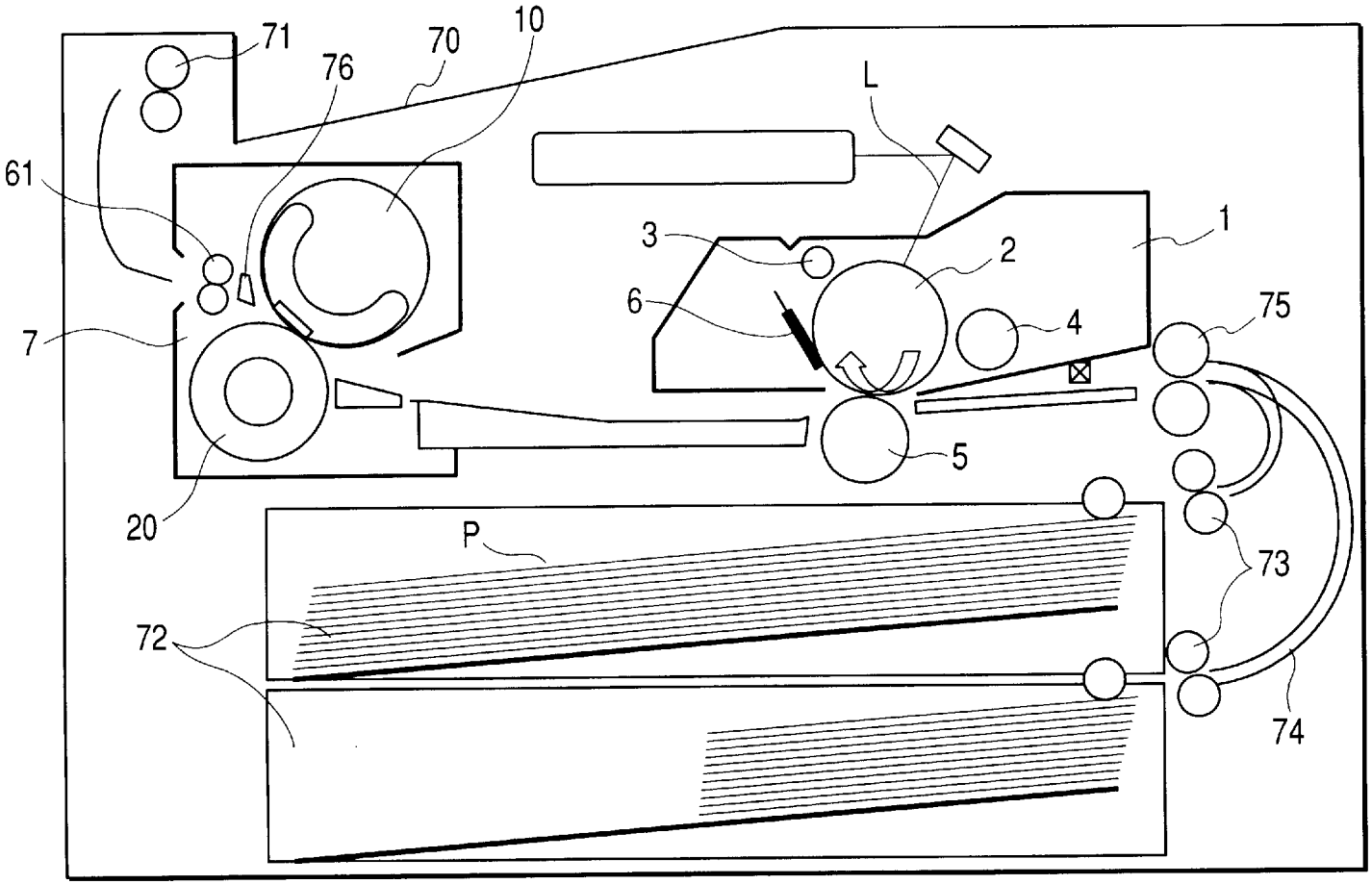
FIG. 5 is a schematic cross-sectional view of a printer in which the image heating apparatus of FIG. 2 is applied.

In the following there will be explained an embodiment of the present invention. FIG. 5 is a schematic view showing an image forming apparatus.

A photosensitive drum 2 is composed of a photosensitive material such as an OPC, amorphous selenium or amorphous Si, formed on a cylindrical substrate such as of aluminum or nickel.

The photosensitive drum 2 is rotated in a direction indicated by an arrow, and its surface is uniformly charged by a charging roller 3 constituting a charging device.

Then a laser scanner 8 executes scanning exposure with a laser beam L which is on/off controlled according to the image information, thereby forming an electrostatic latent image.

The electrostatic latent image is developed and rendered visible by a developing apparatus 4. As the image development, it is used, a jumping development method, a two-component development method, a feed development method etc. and those are often used in a combination of image exposure and reversal development.

The obtained visible toner image is transferred, at a transfer nip portion where the photosensitive drum 2 and a transfer roller 5 serving as a transfer apparatus are in mutual contact, from the photosensitive drum 2 onto a transfer material (recording material) P which is conveyed to the transfer nip portion at a predetermined timing.

The transfer material P is picked up by paired feed rollers 73 from a cassette 72, then advanced through a sheet conveying path 74 to paired registration rollers 75 for sensing the leading end of the sheet, and is conveyed into the transfer nip portion after the timing thereof is matched with the visible image borne on the photosensitive drum 2. In this operation, the transfer material is pinched under a predetermined pressure between and conveyed by the photosensitive drum and the transfer roller.

The transfer material, having received the toner image transferred in the transfer nip portion, is conveyed to a fixing apparatus 7 for fixation as a permanent image, and is discharged through paired discharge rollers 71 onto a discharge tray 70.

On the other hand, retentive toner, remaining on the photosensitive drum 2 after the image transfer is eliminated from the surface of the photosensitive drum by a cleaning member 6.

The photosensitive drum 2, the charging roller 3, the developing apparatus 4 and the cleaning apparatus including the cleaning member 6 are integrally constructed as a process cartridge 1, which is detachably and replaceably mounted the main body of the image forming apparatus.

(B) Heat Fixing Apparatus 7

In the following there will be explained the configuration of the heat fixing apparatus of film heating type, employed in a first embodiment of the present invention, with reference to FIGS. 2 to 4 and 6.

The heat fixing apparatus 7 basically includes a fixing member 10 and a pressure member 20 maintained in mutual pressure contact to form a fixing nip portion N.

1) Fixing Member 10

The fixing member 10 including the following members.

A fixing film 13 of a low thermal capacity (hereinafter represented as metal sleeve), constituting the heat fixing rotary member, has a base layer of a metal of high heat resistance and high thermal conductivity such as stainless steel (SUS), magnesium (Mg), aluminum (Al), nickel (Ni), copper (Cu), zinc (Zn) or titanium (Ti) or an alloy thereof, having a total thickness not exceeding 200 $\mu$m for enabling quick start.

The metal base layer of the metal sleeve 13 optimally has a thickness within a range of 30 to 200 $\mu$m in order to have a sufficient strength for executing the heat fixing step over the prolonged service life.

Also for preventing the offset phenomenon and securing the releasing property for the recording material, the surface is coated or covered with satisfactorily releasing heat-resistant resinous material such as PFA, PTFE or FEP singly or in a mixture.

The metal sleeve 13 constituting the heat fixing rotary member of the present embodiment is composed of a base layer of SUS 304 with a thickness of 35 $\mu$m and with an external diameter of 30.1 mm, in order to enable rapid temperature increase to the fixing temperature within an extremely short time. On the SUS base layer, a conductive primer layer in which a conductive material such as carbon is dispersed in an appropriate amount is coated with a film thickness of 5 $\mu$m. On the conductive primer layer, in order to prevent adhesion of toner or paper dust and to secure releasing of the recording material from the metal sleeve 13, a liquid mixture of PTFE and PFA as fluorinated resin excellent in releasing property and heat resistance is dip coated and sintered with a film thickness of 10 $\mu$m to form a releasing layer. Such base layer, primer layer and releasing layer constitute the metal sleeve 13 of a diameter of 30.1 mm.

The details of the metal sleeve 13, having an inversely crowned shape (a shape including an area in which the external diameter gradually increases toward the ends of the sleeve) which features the present invention will be explained later.

The primer layer of the metal sleeve 13 is exposed in a part of the longitudinal direction and in the circumferential direction, and a diode 28 (FIG. 2) as a rectifying element is connected between such exposed portion and the ground level of the main body with the anode being connected to the primer layer in order that the surface of the metal sleeve does not assume a positive potential for preventing the offsetting and trailing phenomena, whereby the unfixed toner t on the recording material P is prevented from transferring to the fixing film 13.

Figure 3:
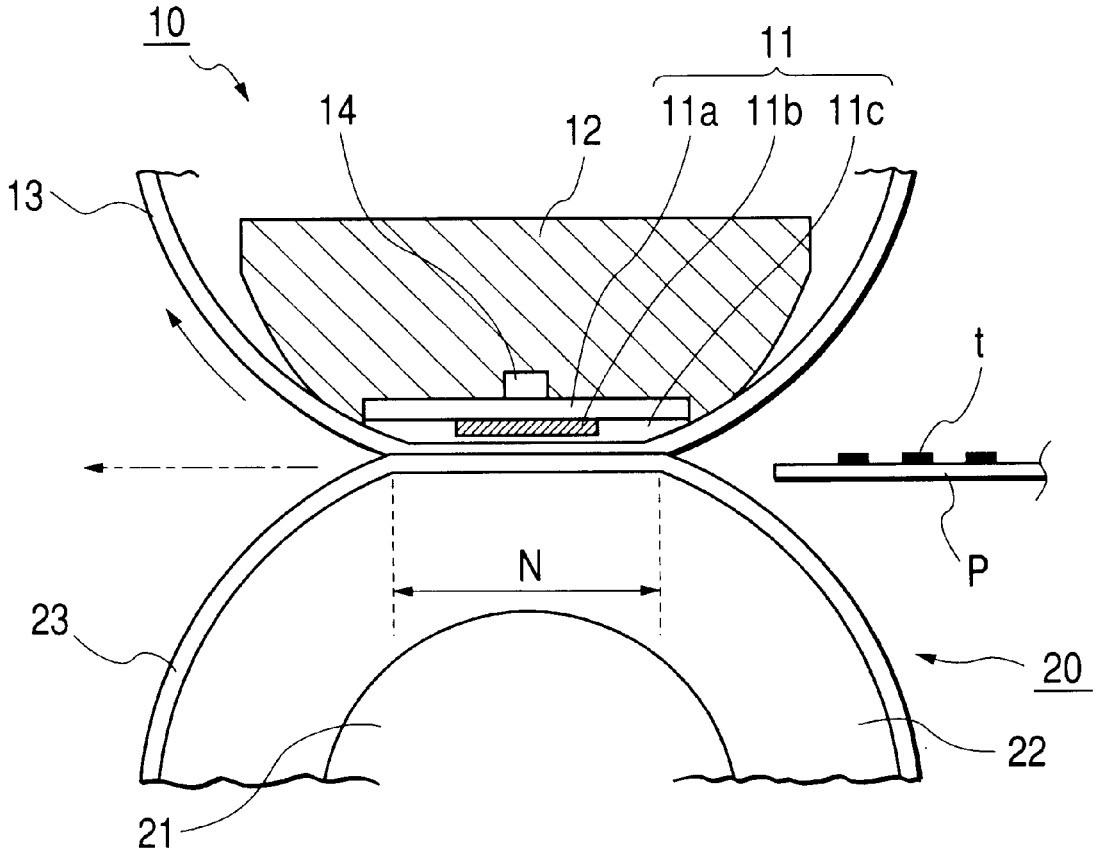
FIG. 3 is a magnified cross-sectional view of the vicinity of a nip portion of the image heating apparatus shown in FIG. 2.
Figure 4:
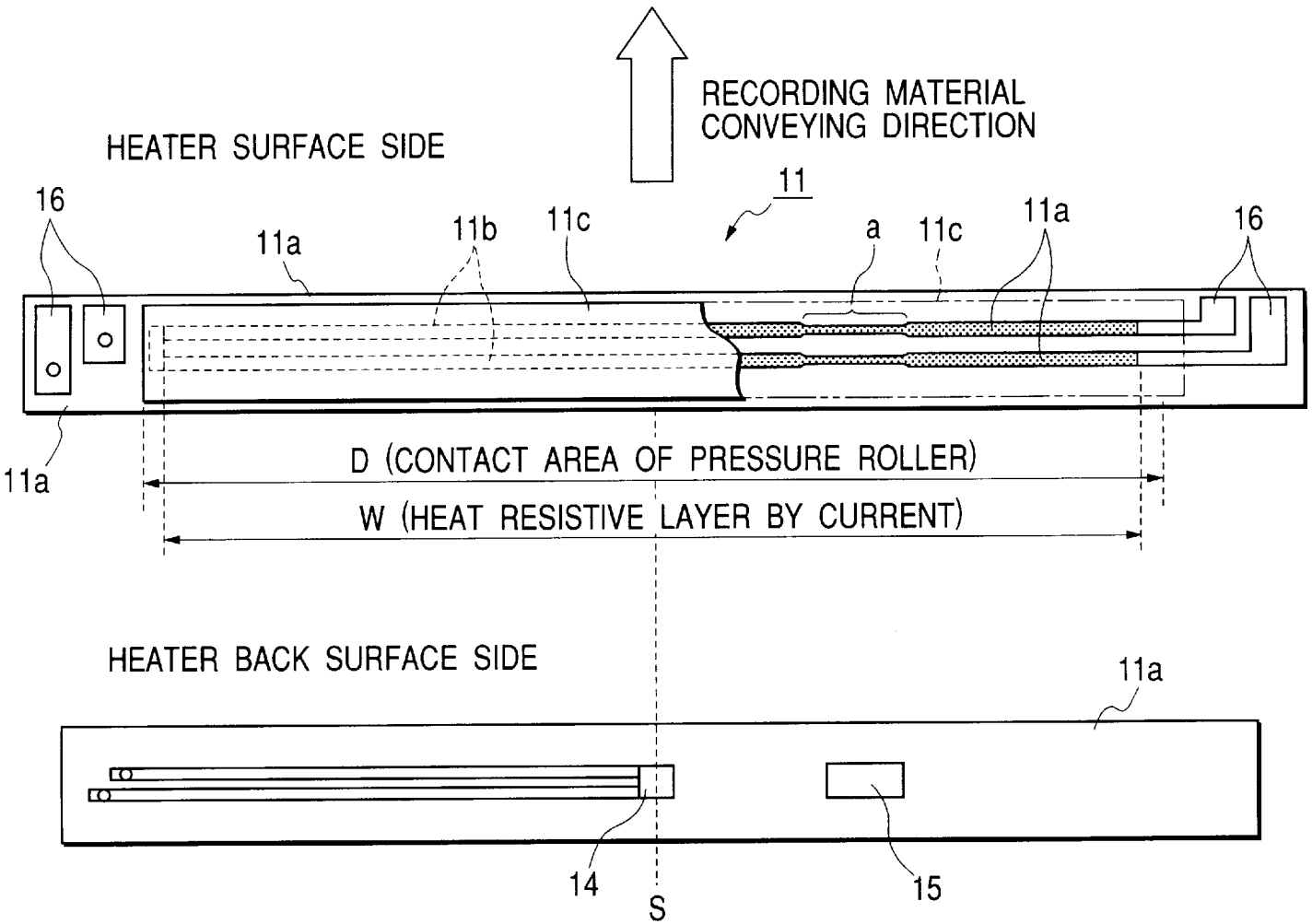
FIG. 4 is a view showing the configuration of a heater of the image heating apparatus shown in FIG. 2.

A heater 11 is provided inside the fixing film, for heating the fixing nip portion N for fusing and fixing the unfixed toner image t on the recording material P. The heater 11, as already explained with reference to FIGS. 3 and 4, is prepared by forming a heat-generating resistance layer 11*b* of silver palladium (Ag/Pd) for example by screen printing, along the longitudinal direction on the surface of the highly insulating ceramic substrate 11*a* such as of alumina ($Al_2O_3$). The heat-generating resistor layer 11*b* has a narrow strip shape of a thickness of about 10 $\mu$m and a width of about 4 mm.

On the rear surface of the ceramic substrate 11*a*, there is provided, at the approximate center of the recording material passing area, a thermistor 14 which constitutes the temperature detecting means for detecting the temperature of the ceramic substrate 11*a*, elevated by the heat from the heat-generating resistor layer 11*b*. According to a signal from the thermistor 14, there is suitably controlled a voltage applied to the heat-generating resistor layer 11*b*, through conductive portions formed on both ends thereof, from electrode portions 16 composed of a silver-platinum alloy (Ag/Pt) and positioned on both longitudinal ends of the heat-generating resistor layer 11*b*, thereby maintaining the temperature of the heater 11 in the fixing nip portion N substantially constant at a predetermined control temperature and providing the heat required for fixing the unfixed toner image t on the recording material P.

The current control to the heat-generating resistor layer 11*b* can be achieved, for example, by a wave number control method in which the supplied electric power is controlled by the wave number of an AC voltage, or a phase control method of current supply from a predetermined delay time after a zero-crossing point of an AC voltage to a next zero-crossing point.

The heater 11 is further provided, on the surface thereof at the side of the fixing nip portion N, with a protective layer 11*c* consisting of a thin glass coating capable of withstanding the friction with the metal sleeve 13. A heat-insulating stay holder 12, for supporting the heater and preventing heat radiation to a side opposite to the fixing nip portion N, is composed for example of liquid crystal polymer, phenolic resin, PPS or PEEK, and the metal sleeve 13 is loosely fitted thereon and is rendered rotatable in a direction indicated by an arrow. In the present embodiment, the heat-insulating stay holder is composed of liquid crystal polymer.

Since the metal sleeve 13 rotates in contact with the heater 11 and the heat-insulating stay holder 12 provided therein, the friction resistance between the heater 11 or the heat-insulating stay holder 12 and the metal sleeve 13 has to be maintained low. For this reason, a small amount of heat-resistant grease is applied onto the surface of the heater 11 and the heat-insulating stay holder 12, thereby enabling smooth rotation of the metal sleeve 13.

Also flanges 17 (FIG. 6) are provided for defining the longitudinal position of the metal sleeve 13 constituting the heat fixing rotary member. Such flanges 17 are composed of a material showing excellent heat resistance and sliding performance but relative low thermal conductivity, for example a resinous material such as PPS, liquid crystal polymer, PET, PI or PA, containing glass fibers.

2) Pressure Member 20

A pressure roller 20, serving as the pressure member, includes a metal core 21 and an elastic layer 22 thereon of a foamed heat-resistant rubber layer such as of silicone rubber or fluorinated rubber. There may further be provided thereon a releasing layer 23 such as of PFA, PTFE or EEP.

Figure 6:
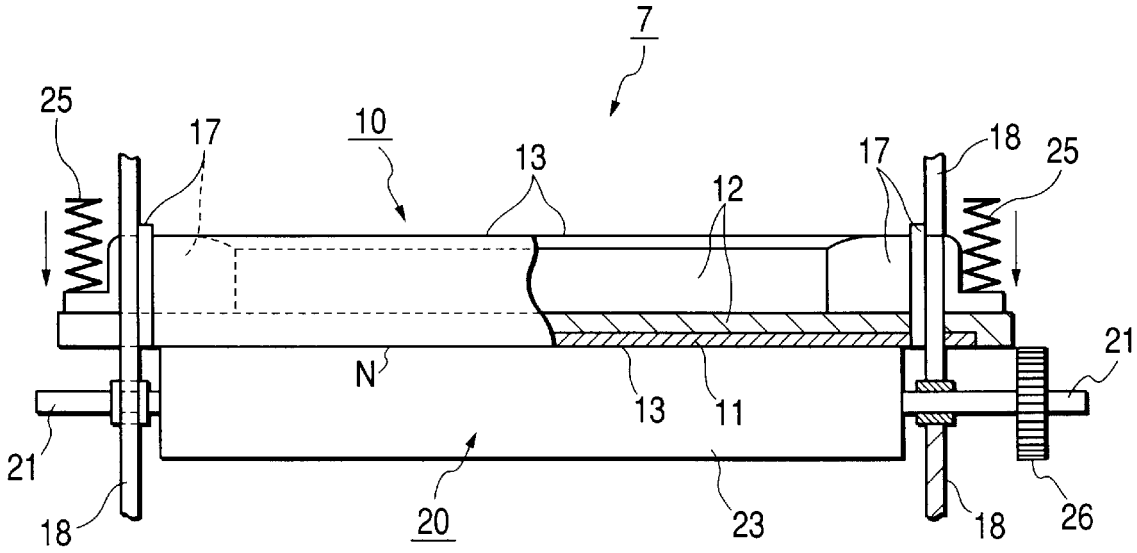
FIG. 6 is a view showing the image heating apparatus shown in FIG. 2 in the longitudinal direction thereof.

As shown in FIG. 6, the pressure roller 20 is supported at both ends of the metal core 21 by bearings, in rotatable manner between rear and front lateral plates 18 of the apparatus, and a fixing member (fixing member assembly) 10 is provided on the pressure roller 20 and is pressurized thereto under a total load of 98N by pressing springs 25 constituting pressurizing means, thereby forming a fixing nip portion N of a width of about 6 mm across the fixing film 13.

The pressure roller 20 employed in the present embodiment has the following configuration.

A pressure roller of an Asker-C hardness of about 54° (under a load of 9.8N) is formed by covering an aluminum metal core 21 of a diameter of 15 mm with a heat-resistant insulating silicone sponge rubber of a thickness of 5 mm as the elastic layer 22 and further with a PFA tube of a thickness of 50 $\mu$m, consisting of fluorinated resin in which carbon is dispersed as the conductive material in 10 to 20 wt. %, as the releasing layer 23.

Also on this pressure roller 20, in order to make a potential difference against the fixing film 13 for preventing the offsetting phenomenon, a diode 28 (FIG. 2) is provided between the metal core 21 of the pressure roller and the ground level of the main body of the apparatus, with the cathode and anode being respectively connected to the metal core 21 and the ground level, thereby causing a positive potential on the surface of the pressure roller and generating an offset preventing potential difference from the fixing film 13.

Figure 2:
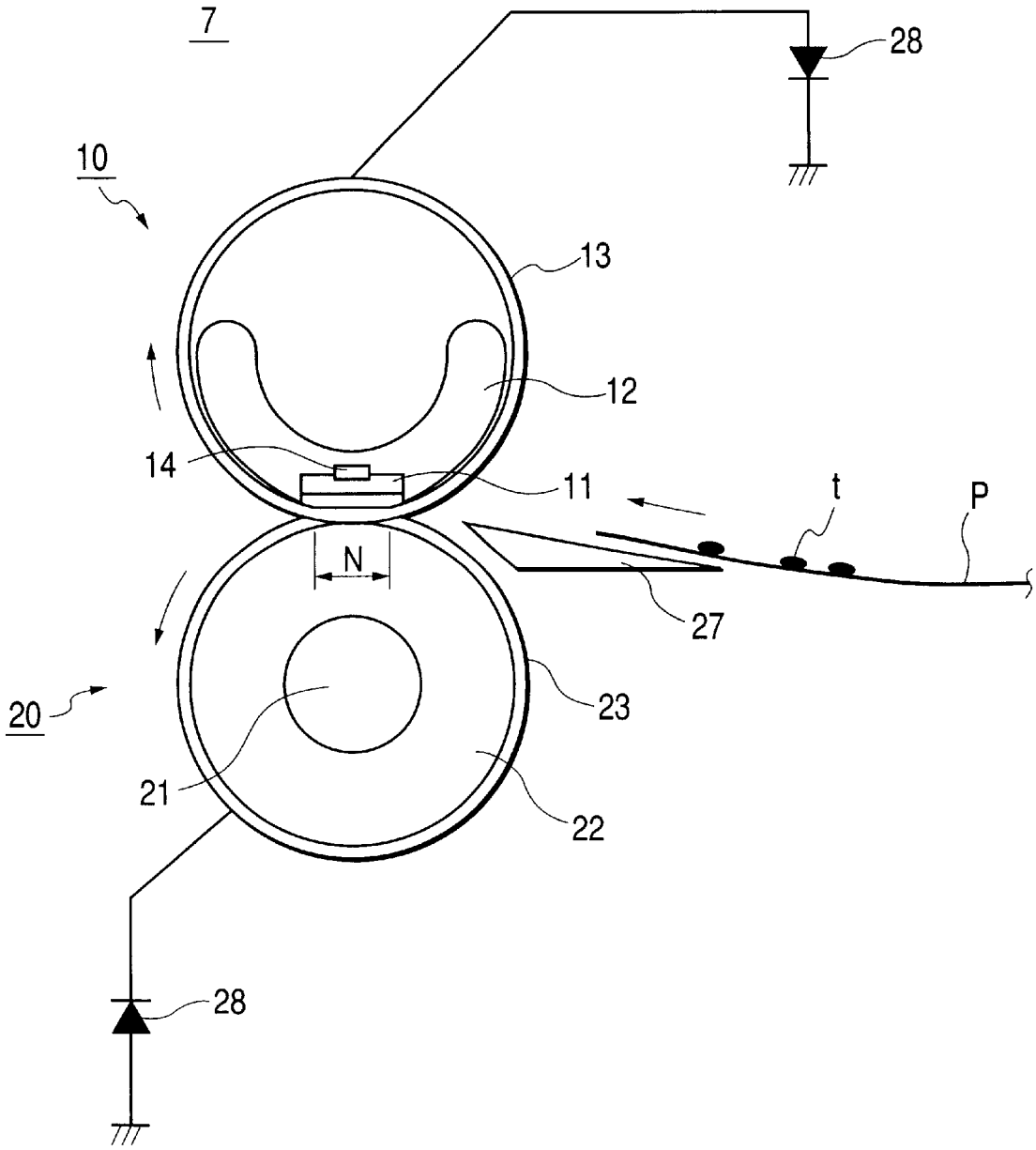
FIG. 2 is a schematic cross-sectional view of an image heating apparatus in which a metal rotary member of the present invention is applicable.

A rotary drive force from an unrepresented drive transmission system is supplied to a pressure roller driving gear 26 (FIG. 6) to rotate the pressure roller 20 couterclockwise as indicated by an arrow in FIG. 2. Therefore, the metal sleeve 13, constituting heat fixing rotary member at the side of the fixing member 10, is driven and rotated outside the stay holder 12.

In the heat fixing apparatus of the above-described configuration, the recording material P bearing the toner image t formed in an image forming unit is guided by a fixing entrance guide 27 (FIG. 2) then is conveyed to and given a pressure and heat in the fixing nip portion N formed between the aforementioned metal sleeve 13 and the pressure roller 20, whereby the unfixed toner image t on the recording material P is fixed thereto as a permanent image.

A sheet discharge sensor 76 (FIG. 5) discriminates whether the recording material P is present in the fixing nip portion N, and outputs a signal to be used for controlling the current supply to the heat-generating resistor layer 11*b* of the heater 11. There are also provided discharge rollers 61 (FIG. 5) for the recording material after fixation.

(C) Base Layer of Metal Sleeve 13

In the following there will be given a detailed explanation on the base layer (base metal pipe; consisting of SUS (stainless steel) in the present embodiment) of the metal sleeve 13 constituting the heat fixing rotary member.

A principal method for producing a cylindrical pipe for use as the base layer of the metal sleeve 13 will be explained with reference to FIGS. 7, 9A to 9C.

Figure 7:
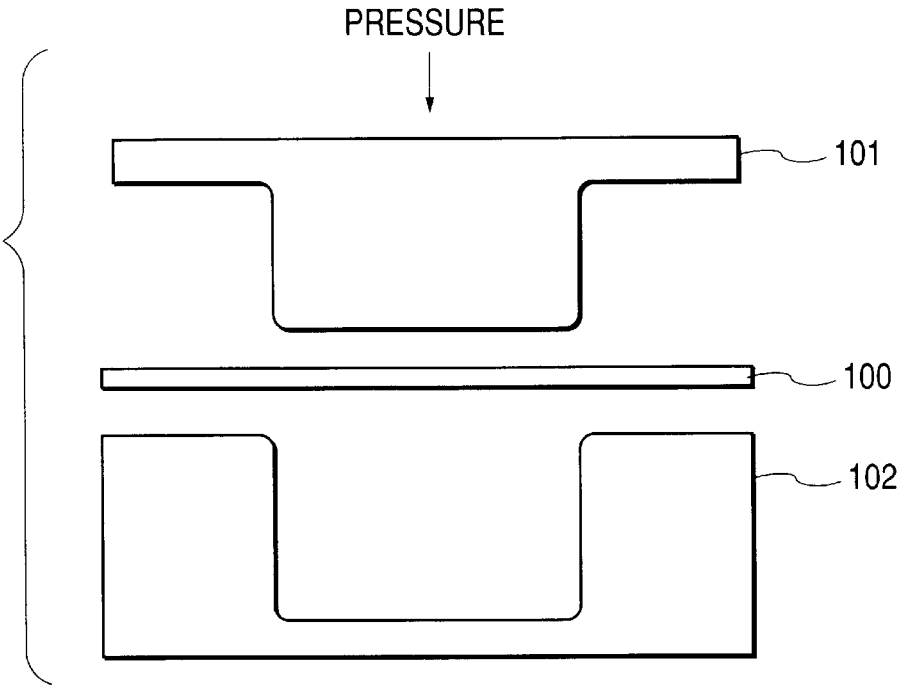
FIG. 7 is a view showing a deep drawing process employed in an embodiment of the present invention.

Referring to FIG. 7, there are shown a stainless steel base material 100 consisting of a metal plate (plank) of a thickness of about 350 $\mu$m, a circular inner mold (punch) 101 use in an ordinary deep drawing process, and an outer mold (die) 102 having the shape of a cylindrical container and having an ultra hard plating on the surface of a metal material.

Referring to FIG. 7, the metal plant 100 is pinched between the inner mold 101 and the outer mold 102, and the inner mold is pressed into toward the outer mold, as indicated by an arrow. In order to facilitate drawing operation, a viscous lubricant oil or a solid lubricant such as graphite or molybdenum disulfide is provided between the metal plant 100 and the outer mold 102.

Figure 8:
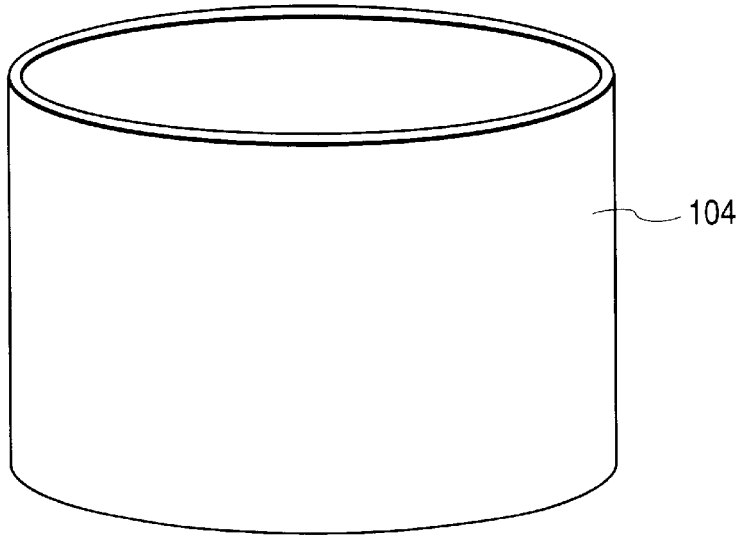
FIG. 8 is a perspective view showing a cup-shaped metal member obtained by the deep drawing process shown in FIG. 7.

The above-described deep drawing process is executed usually 2 to 4 times with different metal molds to obtain a cup-shaped SUS cylindrical member 104 (metal pipe in a first stage) as shown in FIG. 8.

Then an ironing process is applied so that the cylindrical SUS member 104 is formed with a predetermined thickness. Such ironing process may include any working process such as rolling or drawing in the interim, but, as a final step, the cylindrical SUS member is given irregularities not exceeding a predetermined level (about 1 to 3 $\mu$m) in the circumferential direction on the outer peripheral surface by the following working methods.

Figure 9A:
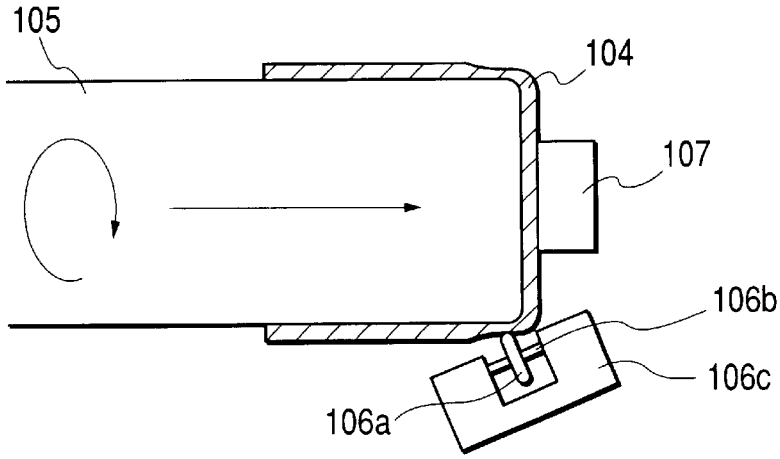
FIG. 9A is a cross-sectional view showing a spinning process employed as the ironing process of the present invention.
Figure 9B:
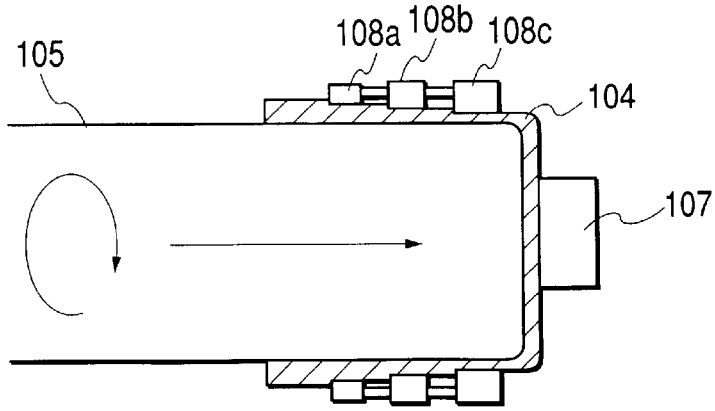
FIG. 9B is a cross-sectional view showing an ironing process with a continuous die.

For example, there may be adopted working methods as shown in FIGS. 9A and 9B. FIG. 9A shows an ordinary drawing/spinning method in which an impinging roller 106*a*, rotatably mounted on a shaft 106*b* which is mounted on a fixed support 106*c*, is pressed toward the inner metal mold 105, always maintaining a predetermined distance therefrom.

The cylindrical SUS member 104, formed into the cup shape by the aforementioned deep drawing, is fitted on the inner metal mold 105, and is fixed by a pressing member 107 in a state where the bottom of the cup shape of the cylindrical SUS member 104 is in close contact with the metal mold 105.

Figure 9C:
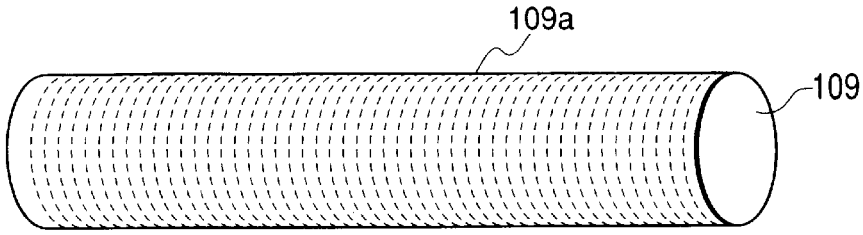
FIG. 9C is a perspective view showing a metal pipe obtained by the ironing process.

In this state, the inner metal mold 105, cylindrical SUS member 104 and pressing member 107 are gradually advanced to the right in the drawings, under rotation in a direction indicated by an arrow. The roller 106*a* is pressed from the end portion, maintaining a predetermined distance from the inner metal mold 105. In this manner, the cylindrical SUS member 104 is made thinner from the end thereof by the ironing process, and such ironing process finally provides, as shown in FIG. 9C, a cup-shaped metal pipe 109 formed into a predetermined thickness and to be used for forming the base layer of the metal sleeve 13 of the present embodiment.

The cup-shaped metal pipe 109 obtained by the ironing process has circumferential irregularities 109*a* as the trace of roller pressing in the spinning process. Finally, the bottom portion of the cup-shaped metal pipe 109 is cut off to obtain a metal pipe 109 (metal pipe in a second stage) to be used for forming the metal sleeve 13 of the present embodiment.

Otherwise, there may also be adopted an ironing process, as shown in FIG. 9B, of pressing the first-stage metal pipe 104 supported by the inner metal mold 105 and the pressing member 107 under rotation into continuous dies 108*a*, 108*b*, 108*c* having stepwise reduced inner diameters instead of the pressing roller, thereby reducing the thickness of the pipe and forming the irregularities in the circumferential direction.

There may also be adopted any other ironing process, such as lancet drawing process, capable of forming irregularities not exceeding a predetermined amount in the circumferential direction of the cylindrical metal member.

In the following there will be explained a method of providing thus formed metal pipe 109 of the second stage with an inversely crowned shape (the inverse shape of a crown).

In the present embodiment, the metal pipe of the second state is subjected to a plastic working to form the base layer (metal pipe of a third stage) of the metal sleeve.

For plastic working in the present embodiment, there is employed bulge forming by a hydraulic pressure. In the hydraulic pressure bulge forming, working liquid is introduced into the interior of a metal pipe to be work and is given a pressure (hereinafter called internal pressure) to form the metal pipe into an arbitrary shape.

Figure 10:
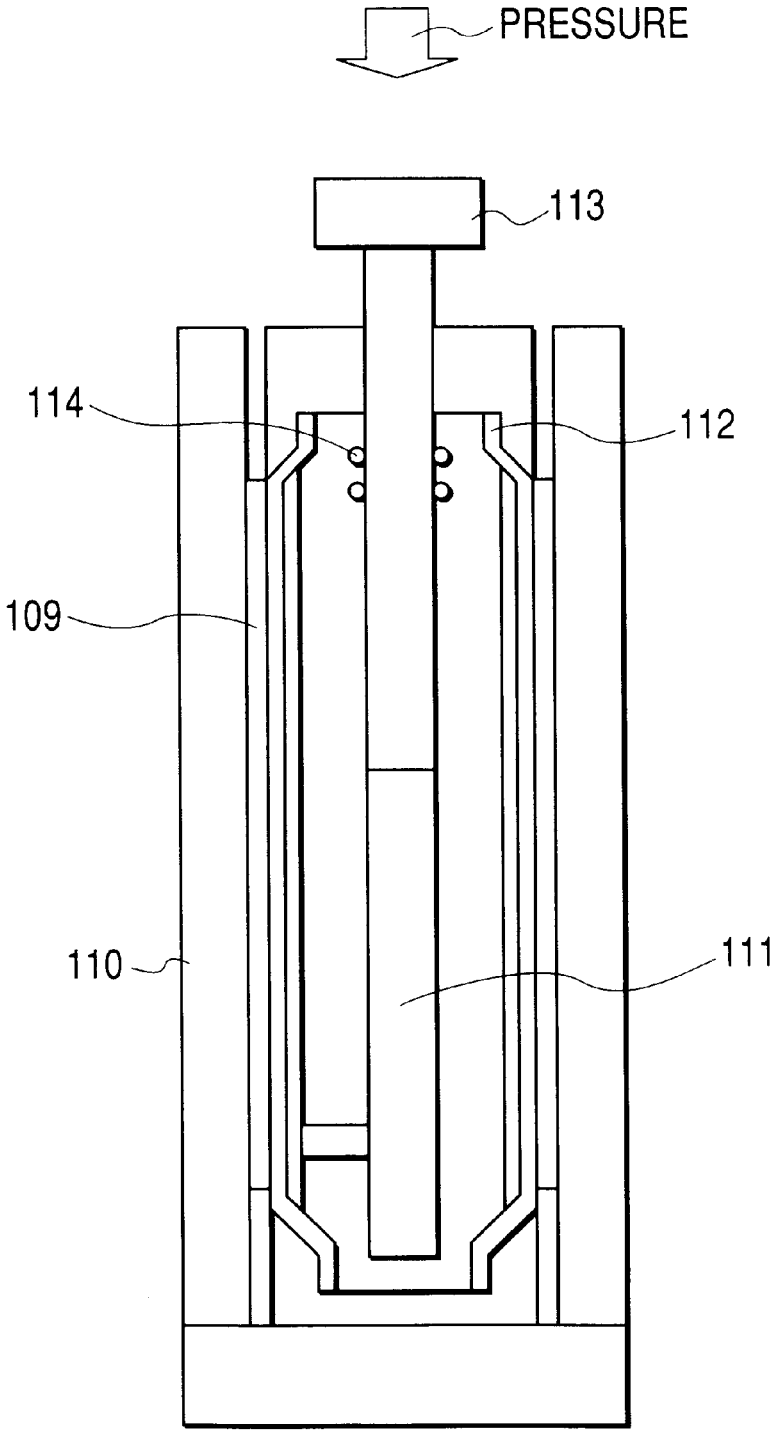
FIG. 10 is a cross-sectional view showing a bulge forming process utilizing a hydraulic pressure as the plastic working.

As shown in FIG. 10, a metal mold 110 having an internal diameter larger at the upper and lower ends than at the central portion is provided around the external periphery of a pipe 109 of the second stage, of which the interior is filled with oil 111. A PFA tube 112 is provided for applying an internal pressure onto the internal periphery of the metal pipe 109. The metal mold 110 for providing the metal pipe 109 with an inversely crowned shape has an internal diameter at the central portion substantially equal to the external diameter of the metal pipe 109 prior to the plastic working. Also the amount of such inverse crowning to be provided to the metal pipe 109 can be arbitrarily selected by adjusting the diameter of the metal mold at the upper and lower ends, whereby the freedom of designing can be increased.

The oil 111 filled in the PFA tube 112 is given a predetermined pressure by a piston 113, and such internal pressure expands the PFA tube 112 and the metal pipe 109 outwards. However, since the external periphery of the metal pipe 109 is limited by the metal mold 110, the metal pipe 109 is spread more in both ends than in the center corresponding to the desired amount of inverse crowning, whereby the metal pipe 109 is given an inversely crowned shape.

In the hydraulic pressure bulge forming employed in the present embodiment, an air pressure of 3 kg/cm$^2$ is used for pressing the piston 113 and is amplified by the piston to apply an internal pressure of 60 kg/cm$^2$ to the PFA tube 112. An oil seal member 114 is provided for preventing leakage of the internal oil 111 under the pressure applied by the piston 113.

In the present embodiment, the hydraulic pressure bulge forming provides the desired inverse crown amount of 100 $\mu$m within a time as short as about 2 seconds. Also the hydraulic pressure bulge forming can provides a stable inverse crown amount by the precision of the metal mold and the support members, and, in the present embodiment, the tolerance of the inverse crown amount was within about ±20 $\mu$m.

In the present embodiment, there has been explained a method of plastic working for obtaining the inversely crowned shape by the internal pressure applied by the PFA tube 112 filled with oil 111. However, such plastic working is not limited to such hydraulic pressure bulge forming process but can also be attained by any other plastic working method capable of providing the metal pipe 109 with the desired inverse crown amount, such as a rubber bulge forming process of placing an elastic member such as silicone rubber, instead of the PFA tube filled with oil, inside the metal pipe 109 and pressurizing such elastic member to cause deformation thereof thereby deforming the metal pipe 109 according to the shape of the metal mold by the internal pressure generated by such deformation.

In the following there will be explained a method of forming a fluorinated resin layer as the releasing layer, in a final principal step, on the external periphery of the metal pipe of the third stage, which has been given the inversely crowned shape by plastic working.

At first, the metal pipe of the third stage was immersed in primer liquid for fluorinated resin, formed by dispersing an appropriate amount of carbon black as a conductivity providing material in the primer for forming an adhesive layer for the fluorinated resin thereby forming a film of a thickness of about 5 $\mu$m by immersion coating. The formed film was then dried for 15 to 45 minutes in a thermostat oven maintained at 190 to 230° C. and cooled at the room temperature.

As the fluorinated resin of the releasing layer, there was employed a mixed fluorinated resin dispersion composed of PTFE resin and PFA resin. In a liquid formed by dispersing an appropriate amount of carbon black as the conductivity providing material in the aforementioned fluorinated resin dispersion, the metal pipe coated with the conductive primer in the foregoing step was immersed for forming a coating layer of a thickness of about 10 $\mu$m by immersion coating. The coated layer was stepwise sintered in a sintering oven for 10 to 15 minutes at ca. 250 to 280° C., then for 20 to 30 minutes at ca. 300 to 330° C. and for 10 to 15 minutes at ca. 370 to 400° C. thereby forming the releasing layer (surface layer of sleeve) of fluorinated resin.

Thus obtained metal sleeve 13, having the metal pipe as the base layer and serving as the heat fixing rotary member, has a total film thickness of about 50 $\mu$m and has a surface coarseness represented by the ten point-averaged height Rz of irregularities of about 0.8 to 1.5.

In the following there will be explained the advantages of the metal sleeve 13 serving as the heat fixing rotary member and prepared by forming the metal pipe 109 of the second stage having flexibility by the ironing process, then executing the plastic working so as to obtain the inversely crowned shape in which the external diameter L2 is larger at both ends than in the central portion L1 and forming the surfacial releasing fluorinated resin layer by sintering.

A process of at first forming the metal pipe 109 to be used as the base member for the metal sleeve 13 by the ironing process, then forming the surfacial releasing fluorinated resin layer by sintering and finally executing the plastic working so as to obtained the inversely crowned shape (namely the plastic forming step and the releasing layer forming step are inverted in order in comparison with the process sequence of the present embodiment) is found to result in the following drawback.

The thermal hysteresis in the stepwise sintering for 10 to 15 minutes at ca. 250 to 280° C., then for 20 to 30 minutes at ca. 300 to 330° C. and for 10 to 15 minutes at ca. 370 to 400° C. for forming the surfacial fluorinated resin layer induces thermal hardening of the metal because of the characteristics thereof, whereby the desired inverse crown amount cannot be obtained.

Figure 11:
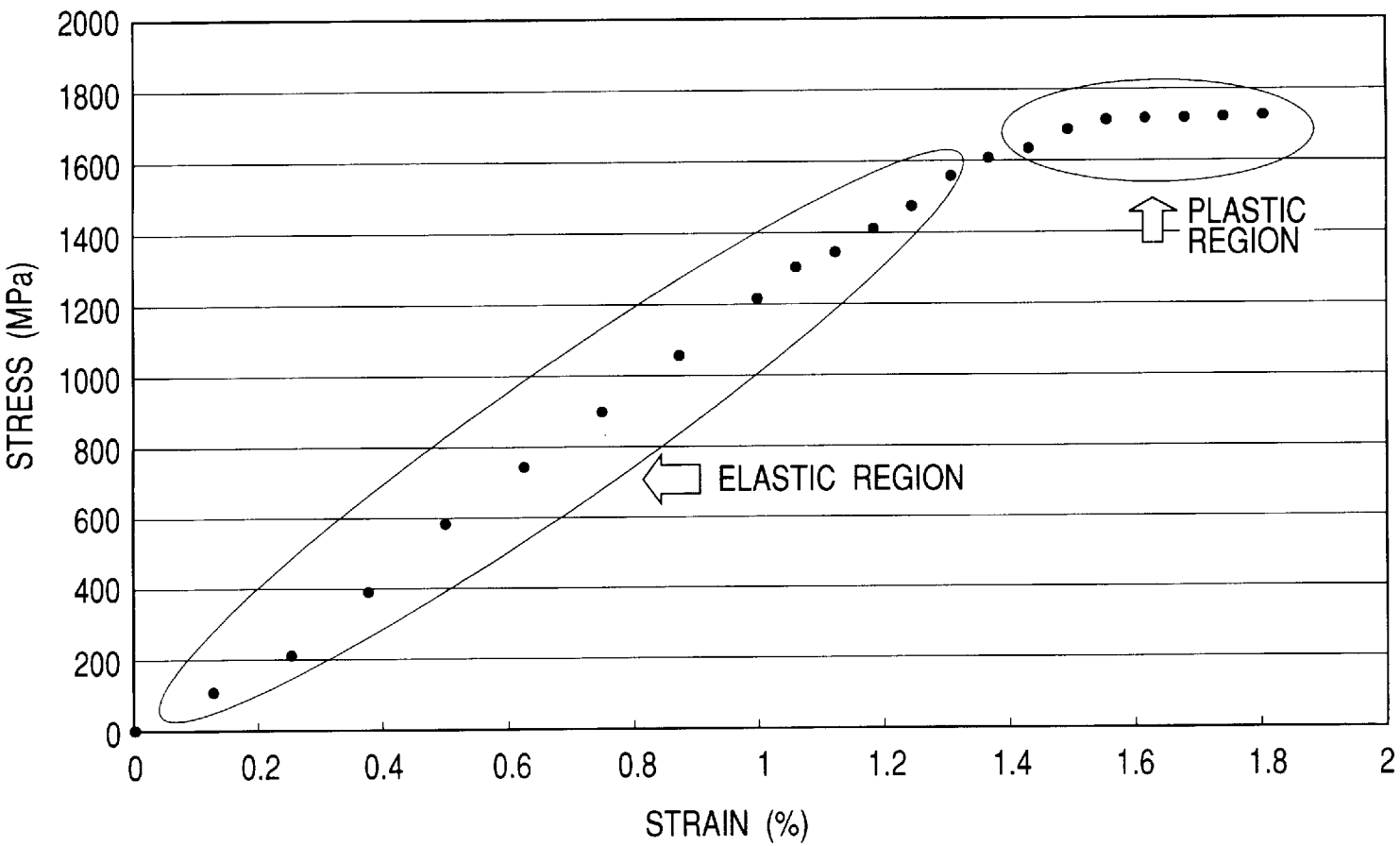
FIG. 11 is a chart showing (strain-stress) characteristics of a stainless steel pipe.

The measurement of the strain in a SUS pipe as a function of stress applied thereto provides a stress-strain relationship (hereinafter represented as S-S characteristics) as shown in FIG. 11. In the chart shown in FIG. 11, in a portion represented as elastic region, a strain is not generated in the SUS metal pipe by the elasticity thereof even under the application of a stress.

In such region, after the plastic working of the present embodiment such as the hydraulic pressure bulge forming, the inverse crown amount cannot be maintained by the elasticity of the SUS metal pipe, when the pressurization is released. On the other hand, in a plastic region, the SUS metal pipe causes a plastic deformation under the application of a stress, and such strain remains as a retentive strain even after the stress is released and such retentive strain is retained as the inverse crown amount.

Figure 1:
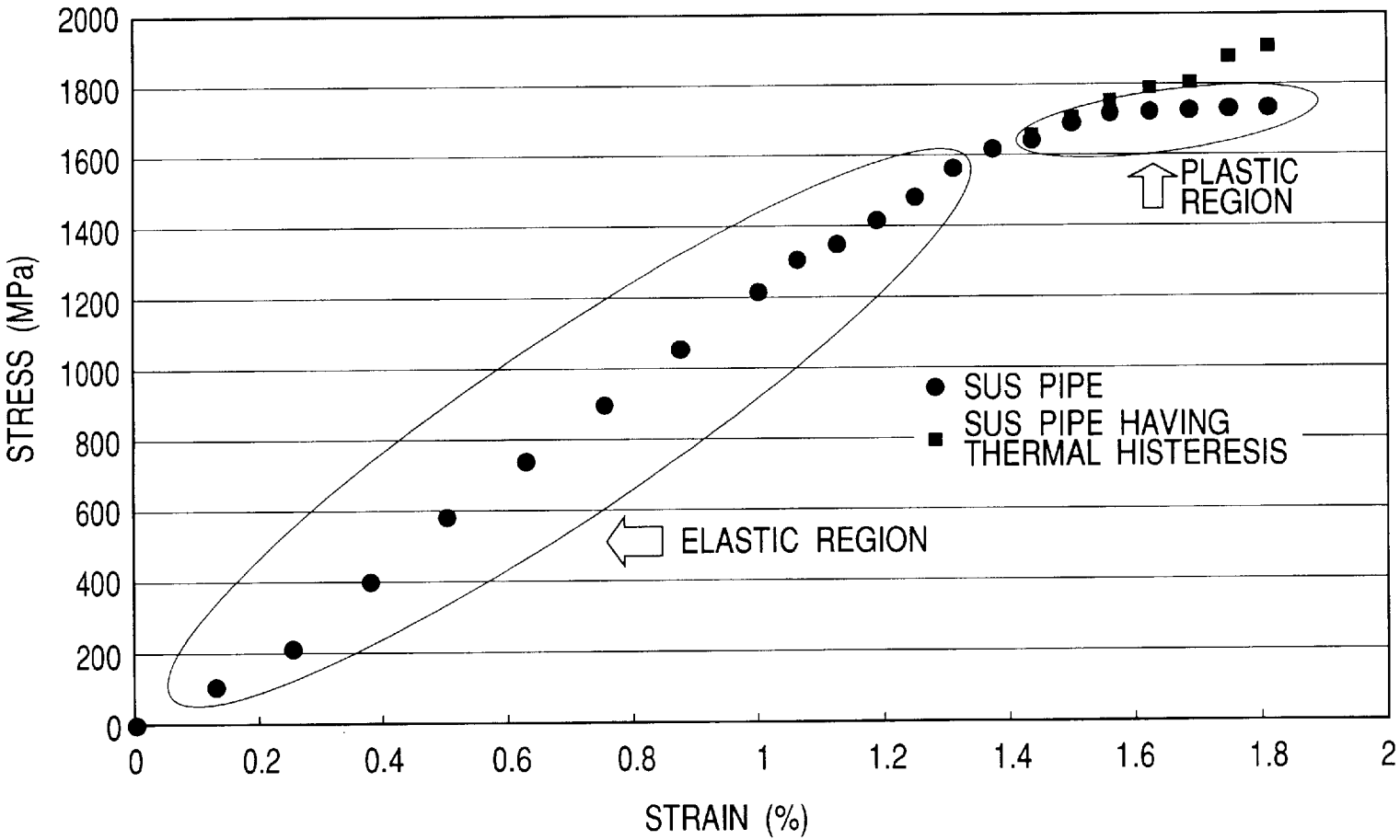
FIG. 1 is a chart showing the (strain-stress) characteristics of a stainless pipe having thermal hysteresis and a stainless pipe without thermal hysteresis.

FIG. 1 shows the S-S characteristics of a SUS metal pipe and another SUS metal pipe subjected to heat application at the sintering of the fluorinated resin. FIG. 1 indicates that the former SUS metal pipe has a plastic region causing a retentive strain in response to a stress and having a strain of about 1.3% or higher (corresponding to a stress of about 1.55 GPa) but the SUS metal pipe subjected to thermal hysteresis does not show a clear transition area from the elastic region to the plastic region. Stated differently, such SUS metal pipe subjected to thermal hysteresis is unable to provide the desired inverse crown amount. Also the tensile strength increased by about 0.25 GPa or more, and a breakage in the metal was observed when a high stress was applied to the SUS metal pipe in order to provide the inverse crowning thereto by plastic working. Such phenomenon is observable also in other metals.

Because of such drawback, the present embodiment adopts the process sequence, for obtaining the desired inverse crown shape, of at first forming the metal pipe of the second stage, then forming the inversely crowned shape by plastic working (metal pipe of third stage), and finally sintering the fluorinated resin layer.

In the following there will be explained the amount of the inversely crowned shape obtained by the aforementioned plastic working. For the SUS metal pipe of the external diameter of Φ30.1 mm employed in the present embodiment, the internal diameter of the metal mold employed in the hydraulic pressure bulge forming was as shown in Table 1 to apply different deformations on the SUS sleeve, thereby obtaining the desired inverse crown amount.

TABLE 1

| | Strain (%) | Retentive strain (%) | Deformation (μm) |
|---|---|---|---|
| Φ30.2 | 0.33 | 0 | 0 |
| Φ30.3 | 0.66 | 0.06 | 18.2 |
| Φ30.35 | 0.82 | 0.2 | 60.2 |
| Φ30.4 | 0.99 | 0.25 | 75.3 |
| Φ30.43 | 1.08 | 0.28 | 84.3 |
| Φ30.44 | 1.12 | 0.33 | 99.3 |
| Φ30.45 | 1.15 | 0.38 | 114.4 |
| Φ30.46 | 1.18 | 0.41 | 123.4 |
| Φ30.47 | 1.21 | 0.43 | 129 |

TABLE 1-continued

| | Strain (%) | Retentive strain (%) | Deformation (μm) |
|---|---|---|---|
| Φ30.48 | 1.25 | 0.48 | 144.5 |
| Φ30.5 | 1.31 | 0.51 | 153.5 |
| Φ30.52 | 1.38 | 0.56 | 168.6 |

The selection as explained in the foregoing of the internal diameter of the metal mold to be employed in the hydraulic pressure bulge forming allows to determine the amount of retentive strain, which remains as a deformation in the SUS metal pipe to provide the inversely crowned shape.

As an example, in the central portion of the metal mold, there is selected an internal diameter of Φ30.2 mm in consideration of the insertion of the SUS metal pipe with the external diameter of Φ30.1 mm into the metal mold, and the selection of Φ30.4 mm for the internal diameter of the metal mold at both ends thereof provides an inverse crown amount of 75.3−0=75.3 μm.

In this manner, an inverse crown amount can be arbitrarily obtained by suitably selecting the internal diameters of the metal mold at the central portion and at both ends thereof so as to obtain the desired inverse crown amount.

In the following there will be explained, with reference to Table 2, the advantages in case the metal sleeve 13, obtained in the aforementioned process sequence and utilizing the SUS metal pipe as the base layer, is employed as the heat fixing rotary member of the heat fixing apparatus.

As an evaluation method, recording materials prone to generate paper wrinkles or uneven gloss are prepared by standing A4-sized sheets of a weight of 65 g/m$^2$ under a high humidity condition of 80%. The paper wrinkles were evaluated in continuous printing of 500 sheets with a print rate of 3%, while the gloss unevenness was evaluated in continuous printing of 50 sheets of a halftone image with a print rate of 30%. Also the inverse crown amount was varied in 5 levels of 0 (straight shape), 25, 35, 50 and 100 μm.

TABLE 2

| Inverse crown amount | Paper wrinkles | Gloss unevenness |
|---|---|---|
| 0 μm | 137/500 | 13/50 |
| 25 μm | 9/500 | 3/50 |
| 35 μm | 2/500 | None/50 |
| 50 μm | None/500 | None/50 |
| 100 μm | None/500 | None/50 |

As shown in Table 2, the drawbacks in quality such as paper wrinkles or gloss unevenness can be prevented if the inverse crown amount of the SUS metal pipe is 50 μm or larger for the paper wrinkels and is 35 μm or larger for the gloss unevenness, as the end portions of the recording material P in a direction perpendicular to the conveying direction thereof is pulled outwards in the fixing nip portion N. Stated differently, an inverse crown amount equal to or larger than 50 μm in the SUS metal pipe allows to avoid the drawbacks in quality resulting from the conveying performance of the recording material P.

In the following there will be explained the determination of the upper limit of the inverse crown amount in the SUS metal pipe. The factors determining such upper limit value include (1) unevenness in the heater nip formed by the SUS metal pipe of the metal sleeve 13 and the heater, and (2) limit in the plastic working.

At first there will be explained the influence on the image fixing ability, as a drawback resulting from the unevenness in the heater nip formed by the SUS metal pipe of the metal sleeve 13 and the heater 11. The fixing nip portion N for fixing the unfixed toner image t on the recording material P is formed as the pressure contact plane of the metal sleeve 13 and the pressure roller 20, but similarly important is a heater nip portion formed by the internal periphery of the SUS metal pipe and the heater 11 serving as the heat source. If such heater nip has a small width or is uneven, the thermal energy from the heater serving as the heat source cannot be efficiently transmitted to the recording material, thereby resulting in defective fixation.

The SUS metal pipe, though being thin and flexible, has rigidity as a metal so that the heater nip assumes an uneven shape thinner at the center and thicker on both ends if the inverse crown amount of the SUS metal pipe becomes excessively large, thereby deteriorating the fixing ability.

Also as already described in the explanation of the image forming apparatus of the present embodiment, the thermistor 14 for monitoring the temperature of the heater 11 and feeding back the detected data for the temperature control is provided at the central portion of the heater in the longitudinal direction thereof. Therefore, if the central portion of the heater nip is thinner, there is reduced the heat amount taken away to the recording material P or the pressure roller 20 constituting the principal destination of the thermal energy, so that the thermistor contact portion can be more easily maintained at the fixing temperature and such temperature can be maintained even at a reduced current supply rate per unit time to the heater 11. On the other hand, since the heater nip is thicker at both ends thereof in the longitudinal direction thereof, whereby the heat amount taken away by the recording material P or the pressure roller 20 becomes larger and the required fixing temperature becomes difficult to maintain, thereby deteriorating the fixing ability.

Table 3 shows the result of evaluation of the aforementioned fixing ability at the end portions of the recording material as a function of the inverse crown amount. In this evaluation, the inverse crown amount was varied in 5 levels of 75, 100, 125, 150 and 170 μm. Also the width of the heater nip was measured from the sticking state of the grease on the sliding glass surface 11*c* of the heater.

TABLE 3

| Inverse crown amount (μm) | Heater nip width (mm) End portions | Heater nip width (mm) Central portion | Fixing ability at end portions |
|---|---|---|---|
| 75 | 6.3 | 6.2 | Pass |
| 100 | 6.4 | 6.0 | Pass |
| 125 | 6.7 | 5.7 | Pass |
| 150 | 7.0 | 5.3 | Pass |
| 170 | 7.4 | 5.2 | Failed |

The results in Table 3 indicate that the satisfactory fixing ability at the end portions can be obtained by selecting the inverse crown amount of the metal sleeve 13 or the SUS metal pipe not exceeding 150 μm.

In the following there will be explained (2) limit of the plastic working.

As explained in the foregoing, the plastic working for providing the SUS metal with the inversely crowned shape is executed within the plastic region in the S-S characteristics, but, even in such plastic region, a breakage results in the metal if the stress (internal pressure) applied for plastic working exceeds a certain range, so that the plastic working has a limit.

In the plastic working by the hydraulic pressure bulge forming method on the metal pipe of the second stage of the present embodiment having a thickness of 35 μm and an external diameter of Φ30.1 mm, a breakage was generated in the end portions of the SUS metal pipe if the inverse crown amount exceeded about 180 μm.

As explained in the foregoing, in case of utilizing the metal sleeve 13, including the SUS metal pipe as the base layer, for the heat fixing rotary member of the heat fixing apparatus, the inverse crown amount of the SUS metal pipe is desirably maintained greater than or equal to 50 μm in order to prevent generation of paper wrinkles or gloss unevenness and less than or equal to 150 μm in consideration of the fixing ability and the limit in the plastic working.

Also as another standpoint, in order to ensure stable rotation of the metal sleeve 13 utilizing the SUS metal pipe as the base layer, an appropriate inverse crown amount is required for the SUS metal pipe.

The internal peripheral surface of the SUS metal pipe is in sliding contact with the heater member, and an increase in the area of such sliding contact improves the stability in the rotation of the metal sleeve 13.

However, as already explained in relation to the image forming apparatus of the present embodiment, the metal sleeve 13 is driven by the rotation of the pressure roller 20, and grease is coated on the internal peripheral surface for assisting such rotational drive. The grease also serves to prevent the frictional abrasion of the SUS metal pipe, heater and heater holder.

Therefore, such increase in the contact area on the internal peripheral surface of the SUS metal pipe is undesirable because it increases the abrasion of the internal peripheral surface of the SUS metal pipe and the metal powder generated by such abrasion further accelerates the abrasion of the internal surface of the SUS metal pipe.

Figure 12:
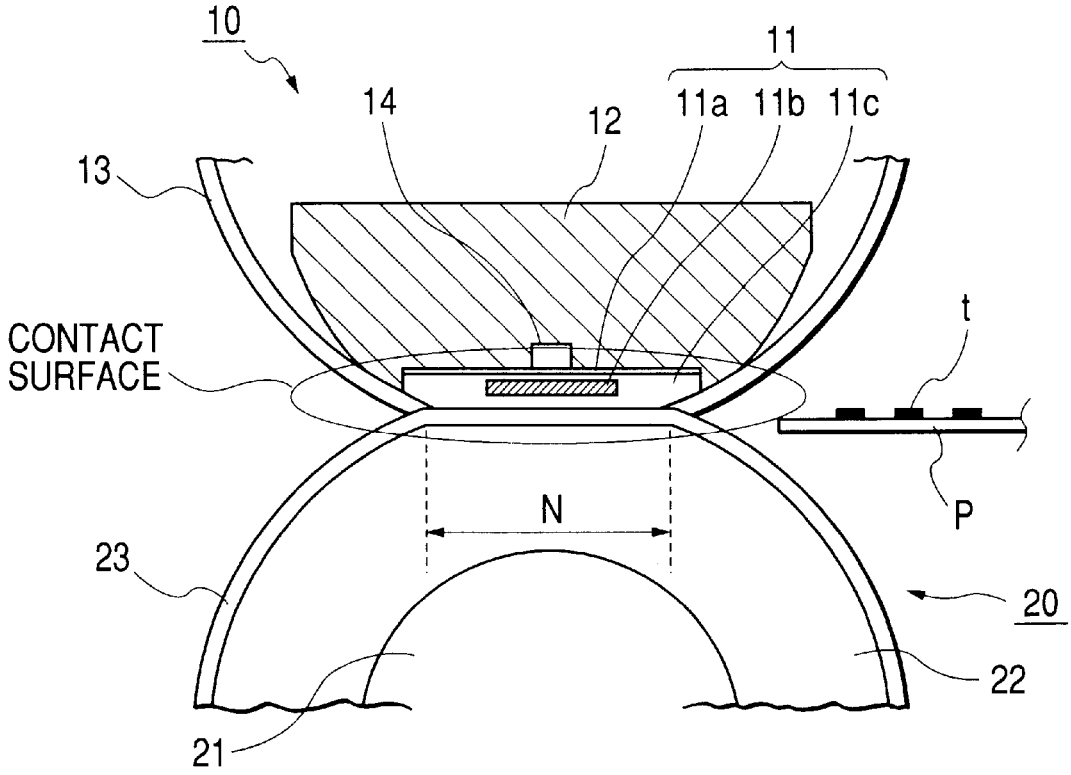
FIG. 12 is a magnified cross-sectional view showing the vicinity of a nip portion of the image heating apparatus of a first embodiment.

For this reason, there is adopted a configuration for reducing the frictional resistance and the frictional abrasion, in which, as shown in FIG. 12, the internal peripheral surface of the metal sleeve 13 is in contact with the heater 11 and the heater holder 12 only in the fixing nip portion N and in the vicinity thereof in the upstream and downstream sides.

In such configuration where the frictional resistance is applied to a smaller area on the internal peripheral surface of the metal sleeve 13, if the inverse crown amount of the SUS metal pipe is excessively large, the contact state thereof with the heater 11 or the heater holder 12 in the longitudinal direction may become unbalanced to hinder smooth driven rotation of the metal sleeve 13.

As a result, the recording material P may lose stability in straight conveying in the fixing nip portion N and may be conveyed in skewed manner in the fixing nip portion N and, in such state, and may be subjected to driving forces unbalanced on both lateral end portions by the pulling action of the inversely crowned shape of the SUS metal pipe of the metal sleeve 13 toward the lateral end portions of the recording material P, thereby resulting in paper wrinkles or gloss unevenness.

In the aforementioned evaluation of the heater nip width and the fixing ability as a function of the inverse crown amount of the SUS metal pipe, the paper wrinkles and the gloss unevenness were also confirmed as summarized in Table 4. The condition of evaluation is the same as that in the determination of the lower limit of the inverse crown shape.

TABLE 4

| Inverse crown amount (μm) | Paper wrinkles | Gloss unevenness |
|---|---|---|
| 75 | None/500 | None/50 |
| 100 | None/500 | None/50 |
| 125 | None/500 | None/50 |
| 150 | None/500 | None/50 |
| 170 | None/500 | 2/50 |

The results shown in Table 4 indicate that the paper wrinkles were not generated but the gloss unevenness was generated in case the inverse crown amount was selected as 150 μm.

As explained in the foregoing, the metal pipe having the desired inverse crown amount can be produced with a high production yield, by at first forming a metal pipe (SUS metal pipe in the present embodiment) by the ironing process, then forming the inversely crowned shape by applying a plastic working in such a manner that the external diameter becomes larger at both ends than in the central portion, and forming the releasing fluorinated resin layer by sintering on the surface of the metal pipe. Also by employing such metal sleeve, there can be obtained a heat fixing apparatus excellent in the conveying ability and heating ability for the recording material.

Second Embodiment

In the following there will be explained a second embodiment of the present invention.

The second embodiment is featured, in the process of producing the metal sleeve 13 composed of a metal pipe of an inversely crowned shape as the base layer and a sintered fluorinated resin layer as the releasing layer on the external peripheral surface thereof and serving as the heat fixing rotary member, in adopting a process sequence different from that of the foregoing first embodiment. In the following, description will be given on such difference only but the advantages of utilizing the heat fixing rotary member of inversely crowned shape in the heat fixing apparatus will not be explained further since they are similar to those in the foregoing first embodiment.

Also the configurations same as those in the prior technology or in the foregoing first embodiment will be omitted from the following description.

Also in the present embodiment, stainless steel (SUS) is employed as the material of the metal pipe. Since the method for producing the SUS metal pipe up to the second stage is similar to that in the foregoing first embodiment, the further explanation is omitted.

In the present embodiment, an annealing process is executed as a first principal step, in order to remove the retentive stress in the metal pipe of the second stage, obtained through the deep drawing process and the ironing process. As already well known, in an extrusion working, a drawing process or a rolling process of a metal material, a part of the stress applied in such working process remains as an unevenness or a change in the crystalline structure in the metal and constitutes a retentive stress, and an annealing process is executed in order to eliminate such retentive stress, by applying heat to the metal material thereby rendering the crystalline structure uniform or finer.

For the SUS material employed in the present embodiment, an annealing process is adequately executed at about 800 to 1100° C. In the present embodiment, the retentive stress in the SUS metal pipe was eliminated by an annealing process for about 60 minutes in a thermostat oven of about 1000° C.

Then the SUS metal pipe of the second stage, subjected to the annealing process, is subjected to the formation by sintering of a fluorinated resin layer as a releasing layer on the surface thereof. The formation by sintering of the fluorinated resin layer will not be explained further as it is similar to that in the foregoing first embodiment.

As a next step, the SUS metal pipe is subjected to a plastic working for providing an inversely crowned shape. Such plastic working will not be explained further as it is similar to that in the foregoing first embodiment.

In the foregoing first embodiment, it has been explained that the sintered formation of the fluorinated resin layer on the surface prior to the formation of the inversely crowned shape in the SUS metal pipe does not allow to obtain the desired inversely crowned shape because the metal is thermally hardened by the thermal hysteresis applied in the sintering. On the other hand, in the present embodiment, the sintered formation of the fluorinated resin layer is executed at first and the plastic working for forming the inversely crowned shape is executed thereafter for the following reason.

In the present embodiment, after the formation of the SUS metal pipe by the deep drawing process and the ironing process, the residual stress in the SUS metal pipe is eliminated by the annealing process, so that the thermal hardening by the thermal hysteresis is not induced by the sintering heat applied at the sintered formation of the fluorinated resin layer. It is therefore possible to obtain the desired inverse crown amount by executing the sintered formation of the fluorinated resin layer at first and then executing the plastic working.

Figure 13:
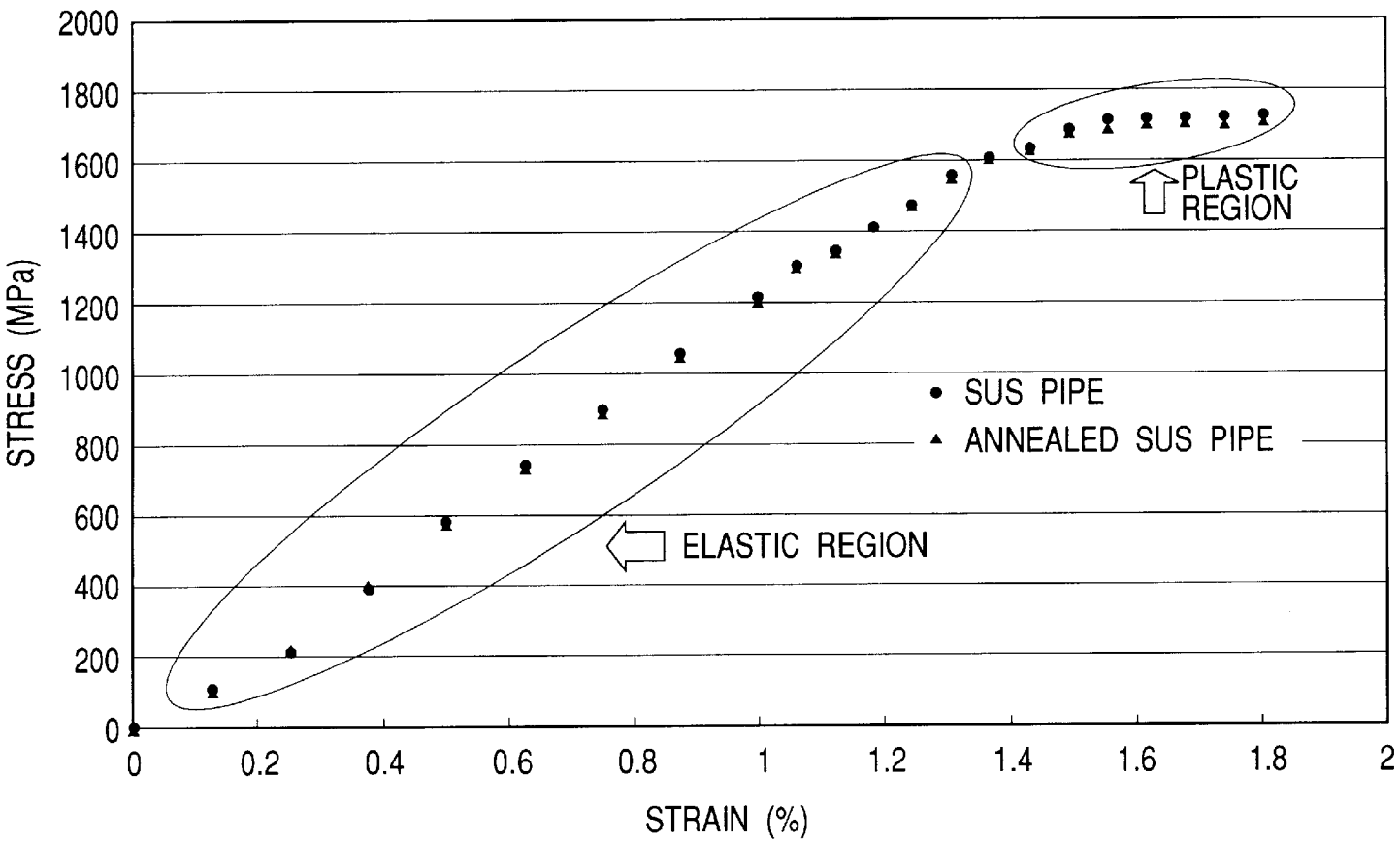
FIG. 13 is a chart showing (strain-stress) characteristics of a stainless steel pipe subjected to annealing and a stainless steel pipe not subjected to annealing.

FIG. 13 shows the S-S characteristics of a SUS metal pipe exposed to the sintering temperature after the annealing process and a SUS metal pipe not subjected to such process. As shown in FIG. 13, the S-S characteristics of the two SUS pipes have substantially same plastic working regions, so that, as explained in the second embodiment, the desired inverse crown amount can be obtained in the annealed SUS metal pipe, also in case of executing the sintered formation of the fluorinated resin layer at first and executing the plastic working for providing the inverse crowned shape later.

As explained in the foregoing, it is rendered possible to provide a metal pipe with a desired inverse crown amount by adopting a process sequence of at first forming a flexible metal pipe (SUS metal pipe in the present embodiment) at first, then executing an annealing process for eliminating the retentive stress in the metal pipe, then executing a next step of forming a releasing fluorinated resin layer on the surface of the metal pipe, and executing a final principal step of executing a plastic working in such a manner that the external diameter becomes larger in both ends than in the central portion, whereby obtained is a metal sleeve 13 having a desired inverse crown amount in stable manner and adapted for use as the heat fixing rotary member in the heat fixing apparatus.

The plastic working in the present embodiment, executed after the formation of the releasing layer, is preferably executed by bulge forming which is achieved by applying a pressure from the interior of the metal pipe, in order not to damage the releasing layer.

The heat fixing apparatus employing such heat fixing rotary member is capable of achieving stable conveying of the recording medium and preventing the deterioration in the fixing ability in the end portions, thereby not causing deterioration of the image quality.

Third Embodiment

In the following there will be explained a third embodiment of the present invention, with reference to FIGS. 14A, 14B and 14C.

The third embodiment is featured, in obtaining the metal pipe having the inversely crowned shape, by forming the inversely crowned shape at the ironing process, instead of at first forming the metal pipe of the second stage the deep drawing process and the ironing process and then executing the plastic working for forming the inversely crowned shape as in the first and second embodiments. In the following, description will be given on such difference only but the advantages of utilizing the heat fixing rotary member of inversely crowned shape in the heat fixing apparatus will not be explained further since they are similar to those in the foregoing first embodiment.

Also in the present embodiment, stainless steel (SUS) is employed as the material of the metal pipe.

At first, as explained in the foregoing first embodiment, a cup-shaped cylindrical metal member (first stage) as shown in FIG. 8 is prepared as the base member of the SUS sleeve, by a deep drawing process explained in FIG. 7.

Then, as in the first embodiment, an ironing process is applied to form the cylindrical metal member in a desired thickness. The ironing process employed in the present embodiment is the drawing-spinning process explained in FIG. 9A.

The drawing-spinning process for producing a thin metal pipe from the cup-shaped cylindrical metal member also constitutes a step of simultaneously providing the inversely crowned shape.

The thin metal pipe is obtained through the drawing-spinning process of plural steps. More specifically, for reaching the thin metal pipe of a thickness of about 35 $\mu$m from the cup-shaped metal pipe of a thickness of about 350 $\mu$m, the drawing process in a single step results in metal breakage, cracking or unevenness in thickness. For this reason, the metal pipe of a desired small thickness is obtained through the ironing process of plural steps. For such drawing process of plural steps, there are preferred 3 to 5 steps. In the present embodiment, four steps of the drawing-spinning process are employed.

In the following there will be explained, with reference to FIGS. 14A, 14B and 14C, the method of providing the metal pipe with the inversely crowned shape.

Figure 14A:
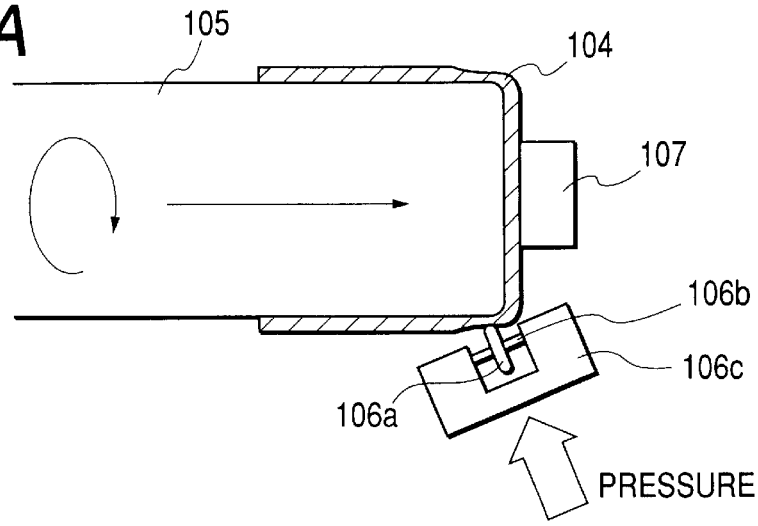
FIGS. 14A, 14B and 14C respectively show an ironing process employed in a third embodiment.

As shown in FIG. 14A, the pressure applied to a fixed table 106*c* is made larger in the end portions in the longitudinal direction of the metal pipe (cup-shaped) 104 than in the center thereof to expand the metal pipe, whereby obtained is a thin metal pipe in which the end portion is wider (larger external diameter) than the center in the longitudinal direction. Such control of the pressure on the pressing roller 106*a* within a step of the drawing-spinning process along the longitudinal direction of the metal sleeve allows to obtain a metal pipe having an inversely crowned shape in which the external diameter is larger in the end portion than in the center in the longitudinal direction.

Figure 14B:
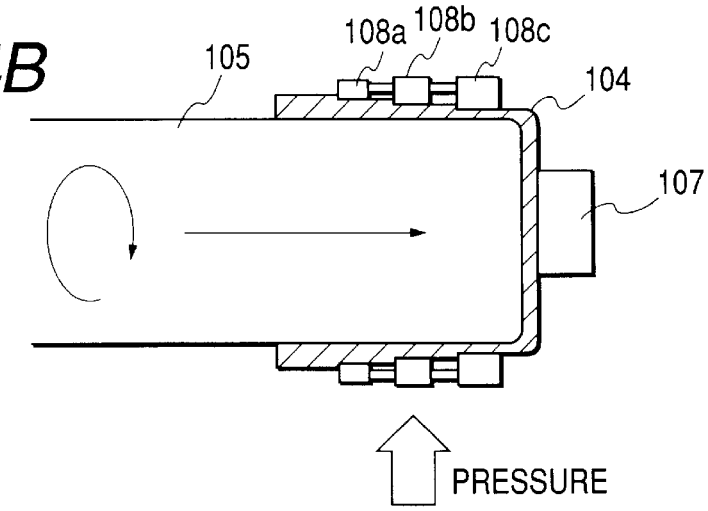
Figure 14C:
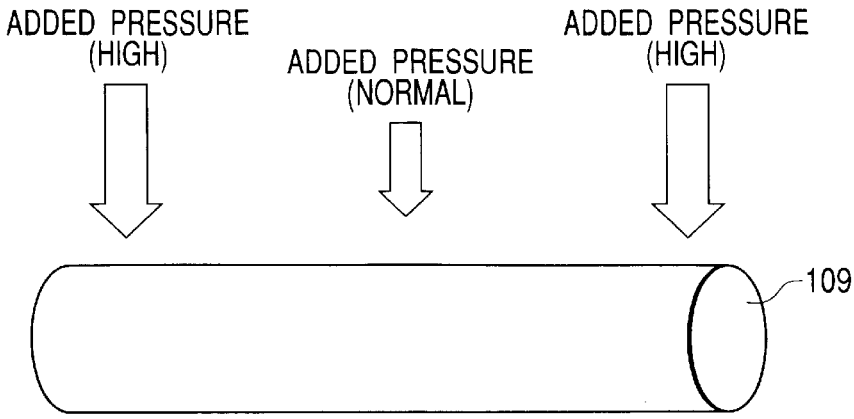
Figure 15:
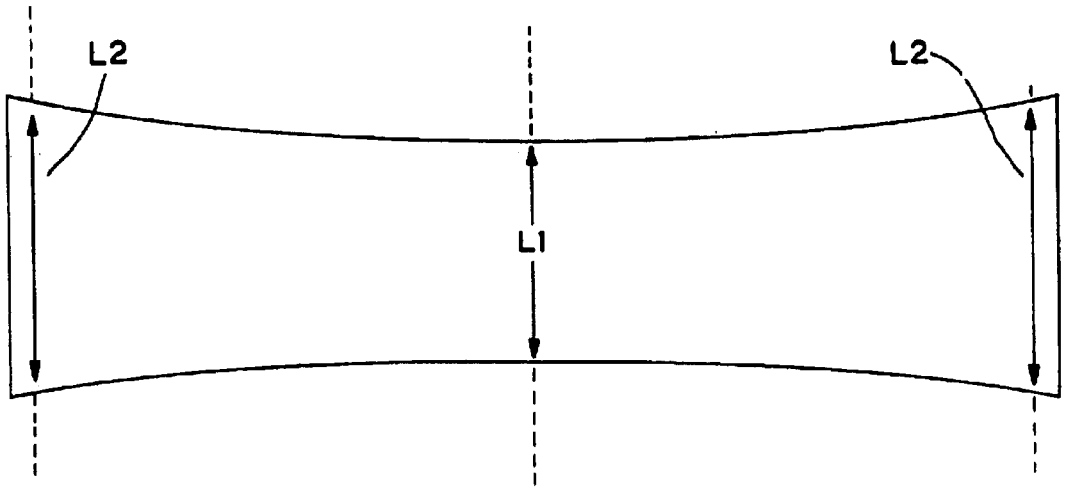
FIG. 15 is a schematic cross-sectional view of a rotary member in which an external diameter increases toward each end portion.

Also as an alternative method, the ironing process utilizing the continuous dies explained in the foregoing first embodiment in relation to FIG. 9B allows to provide the thin metal pipe with the inversely crowned shape in a similar manner within the step of such ironing process (FIG. 14B).

Also for providing the metal pipe with the inversely crowned shape in the ironing process, in addition to the above-described method of controlling the pressure applied to the metal member for ironing the metal pipe, there can also be effectively employed a method of controlling the rate of advancing the inner metal mold 105 under rotation, as shown in FIGS. 14A and 14B. More specifically, at the longitudinal end portion of the metal pipe 104, the advancing speed is maintained low to achieve stronger ironing effect, thereby expanding the metal pipe (expanding the external diameter), but, at the longitudinal center portion, the advancing speed is maintained in normal manner thereby forming a thin metal pipe of which the external diameter increases toward the longitudinal end portions.

Also the control of the pressure on the pressing roller 106*a* and the control of the advancing speed of the inner metal mold, mentioned above, may be used in combination for providing the thin metal pipe with the inversely crowned shape within the step of the ironing process. Also there may be employed any other iron process if the inversely crowned shape can be provided to the thin metal pipe within the step of the ironing process.

In the present embodiment, the aforementioned ironing process of controlling the pressure on the pressing member 106*c* is employed in the last step prior to the formation of the releasing layer to provide an inversely crowned shape of about 100 $\mu$m. Naturally the inversely crowned shape may be provided by the ironing process of plural times.

In the metal pipe formed by the method of the present embodiment in which the inversely crowned shape is provided simultaneously with the formation of the thin metal pipe in the ironing process, the thickness is smaller in the longitudinal end portions than in the longitudinal center because the inversely crowned shaped is obtained by expanding the longitudinal end portions of the metal pipe, but the difference in thickness is considerably smaller in comparison with the thickness of about 35 $\mu$m of the metal pipe. The difference in thickness of the metal pipe, obtained in the aforementioned process, between the center and the end portions did not exceed 1 $\mu$m, and was practically completely acceptable in the use of the thin metal pipe having the inversely crowned shape.

The metal pipe thus obtained and having the inversely crowned shape is subjected to the formation, on the external peripheral surface, of the releasing fluorinated resin layer as a final principal step, but such step will not be explained further because it is similar to that in the foregoing first embodiment.

As explained in the foregoing, the ironing process step for forming the thin metal pipe is also used for simultaneously providing the inversely crowned shape to obtain the SUS sleeve, whereby obtained is a heat fixing rotary member advantageous in cost and in stability of quality because of the reduced number of the process steps. Also the heat fixing apparatus employing such heat fixing rotary member is capable, as in the foregoing first and second embodiments, of achieving stable conveying of the recording medium and preventing the deterioration in the fixing ability in the end portions, thereby not causing deterioration of the image quality.

Others

1) The material of the metal pipe constituting the metal sleeve 13 or the heat fixing rotary member is naturally not limited to stainless steel employed in the foregoing embodiments.
2) The present invention is likewise effective in the heat fixing apparatus of oil type or that of oilless type.
3) The heating member (heater) may be a heat generating member by electromagnetic induction.
4) The heat fixing apparatus of the present invention includes an image heating apparatus for temporarily fixing the image on a recording material, and an image heating apparatus for improving the surface properties, such as luster, of the image.

The present invention is not limited by the aforementioned embodiments but includes any and all variations and modifications within the scope of the present invention.

What is claimed is:

1. An image heating apparatus comprising:

a heater;

a rotary member having flexibility and rotated in contact with said heater, said rotary member including a metal base layer; and a back-up member for forming a nip portion by sandwiching said rotary member between said heater and said back-up member;

wherein said rotary member includes an area in which an external diameter increases toward each end portion of said rotary member in a longitudinal direction.

2. An image heating apparatus according to claim 1, wherein said base layer is obtained by plastic working of a metal pipe having flexibility.

3. An image heating apparatus according to claim 1, wherein a difference in the external diameter of said rotary member between the approximate center and the end portions is greater than or equal to 50 and less than or equal to 150 $\mu$m.

4. An image heating apparatus according to claim 1, wherein said base layer has a thickness greater than or equal to 30 and less than or equal to 200 $\mu$m.

5. An image heating apparatus according to claim 1, wherein the material constituting said base layer is stainless steel.

6. An image heating apparatus according to claim 1, wherein said back-up member has a shape of a roller and said rotary member is rotated by receiving a driving force from said back-up member.

7. An image heating apparatus according to claim 1, wherein a recording material bearing an image is pinched and conveyed between said rotary member and said back-up member.

8. A rotary member for use in an image heating apparatus, comprising:

a metal base layer having flexibility, wherein said rotary member includes an area in which an external diameter increases toward each end portion of said rotary member in a longitudinal direction.

9. A rotary member according to claim 8, wherein said base layer is obtained by plastic working of a metal pipe having flexibility.

10. A rotary member according to claim 8, wherein a difference in the external diameter of said rotary member between the approximate center and the end portions is greater than or equal to 50 and less than or equal to 150 $\mu$m.

11. A rotary member according to claim 8, wherein said base layer has a thickness greater than or equal to 30 less than or equal to 200 $\mu$m.

12. A rotary member according to claim 8, comprising a heat resistant resin layer around said base layer.

13. A rotary member according to claim 8, wherein a material constituting said base layer is stainless steel.

14. A method for producing a rotary member for use in an image heating apparatus, comprising the steps of:

ironing a metal pipe having flexibility;

executing plastic working on a metal pipe subjected to said ironing thereby forming an area in which an external diameter increases toward each end portion of said rotary member in a longitudinal direction; and sintering a resin layer on a surface of the metal pipe subjected to said plastic working.

15. A producing method according to claim 14, further comprising, prior to said ironing step, a step of deep drawing a metal plate thereby forming said metal pipe having flexibility.

16. A producing method according to claim 14, wherein said plastic working is bulge forming.

17. A producing method according to claim 14, wherein said plastic working is second ironing.

18. A method for producing a rotary member for use in an image heating apparatus, comprising the steps of:

ironing a metal pipe having flexibility thereby forming an area in which an external diameter increases toward each end portion of said rotary member in a longitudinal direction; and sintering a resin layer on a surface of the metal pipe subjected to said ironing.

19. A producing method according to claim 18, further comprising, prior to said ironing step, a step of deep drawing a metal plate thereby forming said metal pipe having flexibility.

20. A method for producing a rotary member for use in an image heating apparatus, comprising the steps of:

ironing a metal pipe having flexibility;

annealing the metal pipe subjected to said ironing;

sintering a resin layer on a surface of the metal pipe subjected to said annealing; and executing plastic working on the metal pipe subjected to formation of the resin layer thereby forming an area in which an external diameter increases toward each end portion of said rotary member in a longitudinal direction.

21. A producing method according to claim 20, further comprising, prior to said ironing step, the step of deep drawing a metal plate thereby forming said metal pipe having flexibility.

22. A producing method according to claim 20, wherein said plastic working is bulge forming.

* * * * *

UNITED STATES PATENT AND TRADEMARK OFFICE

CERTIFICATE OF CORRECTION

PATENT NO. : 6,794,611 B2
DATED : September 21, 2004
INVENTOR(S) : Hiroshi Kataoka et al.

It is certified that error appears in the above-identified patent and that said Letters Patent is hereby corrected as shown below:

Column 21,
Line 50, “less” should read -- and less --.

Signed and Sealed this

Twenty-eighth Day of December, 2004

JON W. DUDAS
*Director of the United States Patent and Trademark Office*